United States Patent [19]

Masuda

[11] Patent Number: 4,537,497

[45] Date of Patent: Aug. 27, 1985

[54] IMAGE RECORDING APPARATUS

[75] Inventor: Shunichi Masuda, Wakabayashi, Japan

[73] Assignee: Canon Kabushiki Kaisha, Tokyo, Japan

[21] Appl. No.: 449,843

[22] Filed: Dec. 15, 1982

[30] Foreign Application Priority Data

Dec. 21, 1981 [JP] Japan ..... 56-205175
Dec. 21, 1981 [JP] Japan ..... 56-205176

[51] Int. Cl.[3] ..... G03G 15/00

[52] U.S. Cl. ..... 355/14 R; 355/14 SH; 355/3 SH; 355/24

[58] Field of Search ..... 355/3 SH, 14 SH, 3 R, 355/14 R, 24, 23; 271/279, 280; 346/153.1; 358/296, 300

[56] References Cited

U.S. PATENT DOCUMENTS

| | | | |
|---|---|---|---|
| 4,278,344 | 7/1981 | Sahay | 355/14 SH |
| 4,291,341 | 9/1981 | Yajima | 355/14 C X |
| 4,329,046 | 5/1982 | Burkett et al. | 355/14 SH X |
| 4,330,197 | 5/1982 | Smith et al. | 355/3 SH X |
| 4,365,886 | 12/1982 | Murakami et al. | 355/3 SH |
| 4,385,825 | 5/1983 | Kaneko | 355/3 SH |

*Primary Examiner*—A. C. Prescott
*Attorney, Agent, or Firm*—Fitzpatrick, Cella, Harper & Scinto

[57] ABSTRACT

An image recording apparatus such as a copying machine is capable of both sides recording and overlay recording. In the overlay record mode, after a predetermined format for stock certificates or the like is recorded on transfer sheets, different names or the like are recorded on the format. The apparatus can automatically control the operation sequence without requiring complex mechanisms and procedures.

13 Claims, 21 Drawing Figures

| FIG. 1A | FIG. 1B |
|---|---|

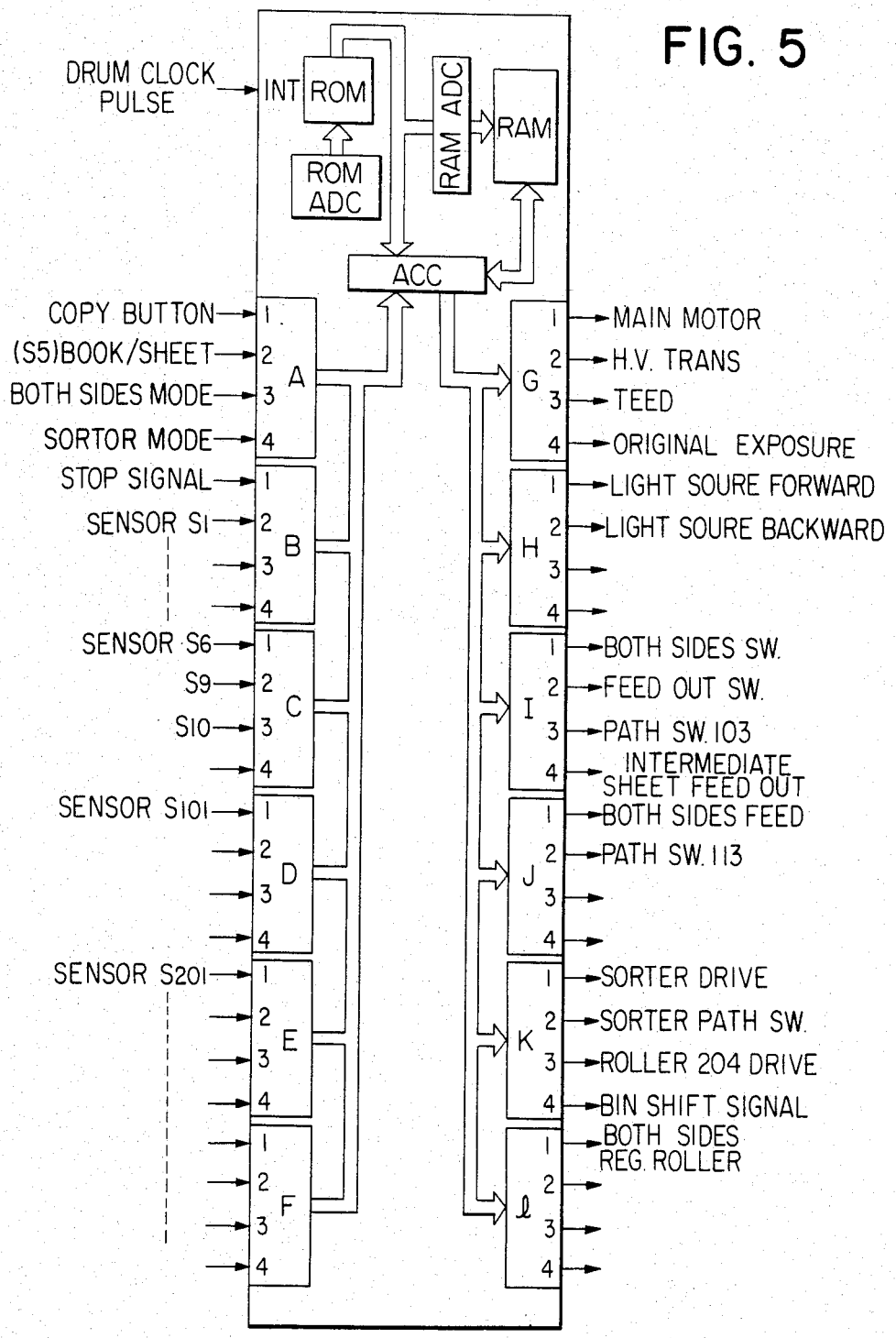
FIG. 5
DRUM CLOCK PULSE
INT
ROM
ROM ADC
RAM ADC
RAM
ACC
COPY BUTTON
(S5)BOOK/SHEET
BOTH SIDES MODE
SORTOR MODE
STOP SIGNAL
SENSOR S1
SENSOR S6
S9
S10
SENSOR S101
SENSOR S201
A
B
C
D
E
F
G
H
I
J
K
ℓ
MAIN MOTOR
H.V. TRANS
TEED
ORIGINAL EXPOSURE
LIGHT SOURE FORWARD
LIGHT SOURE BACKWARD
BOTH SIDES SW.
FEED OUT SW.
PATH SW. 103
INTERMEDIATE SHEET FEED OUT
BOTH SIDES FEED
PATH SW. 113
SORTER DRIVE
SORTER PATH SW.
ROLLER 204 DRIVE
BIN SHIFT SIGNAL
BOTH SIDES REG. ROLLER

| | |
|---|---|
| FIG. 7A | FIG. 7D |
| FIG. 7B | FIG. 7E |
| FIG. 7C | |

| | |
|---|---|
| FIG. 8A | FIG. 8C |
| FIG. 8B | FIG. 8D |

OPTICAL SYS (H1)
ORIGINAL EXPOSURE (G0)0
OTHER COPY CONTROL
S42
S43
STOP ?
YES
NO
S44
COPY END ?
YES
NO
NO
F/SORTOR ?
S45
S47
FEED OUT SW (I2) OFF
YES
SUB. A
S46
NO
F/S9=1
S48
YES
YES
DETECTED SHEET S9=1 ?
S49
NO
ROLLER 93(ℓ1) ON
ROLLER 92 OFF
F/S9 RESET
S50
C
YES
S101=1
S51
NO
BOTH SIDES FEED (J1) OFF
S52
E

IMAGE RECORDING APPARATUS

BACKGROUND OF THE INVENTION

1. Field of the Invention

The present invention relates to an image recording overlay apparatus for automatically recording an image on one side of a paper sheet, on the same side of which another image has already been formed.

2. Description of the Prior Art

In order to perform, with a conventional copying machine, overlay recording for recording different names, addresses and the like on sheets of a predetermined format such as stock certificates, shipping slips of department stores, resident cards and the like, a complex mechanism designed for this purpose must be attached to the machine. Complex procedures are also required.

SUMMARY OF THE INVENTION

It is an object of the present invention to provide an image recording apparatus which eliminates the problem with the conventional copying machine, and which is capable of automatically performing overlay recording without requiring a a complex mechanism and a complex procedure.

It is still another object of the present invention to provide an image recording apparatus which is capable of overlay-recording in a recording mode, wherein an image is recorded on one side of a paper sheet, on the same side of which another image was already recorded in another recording mode.

It is still another object of the present invention to provide an image recording apparatus which has a sheet conveying section for both sides recording, and another sheet conveying section for overlay recording.

The above and other objects and features of the present invention will become apparent from the following description.

BRIEF DESCRIPTION OF THE DRAWINGS

FIG. 5 is a block diagram showing the configuration of a control circuit of the copying machine shown in FIG. 1;

DETAILED DESCRIPTION OF THE PREFERRED EMBODIMENTS

Figures 1, 1B:
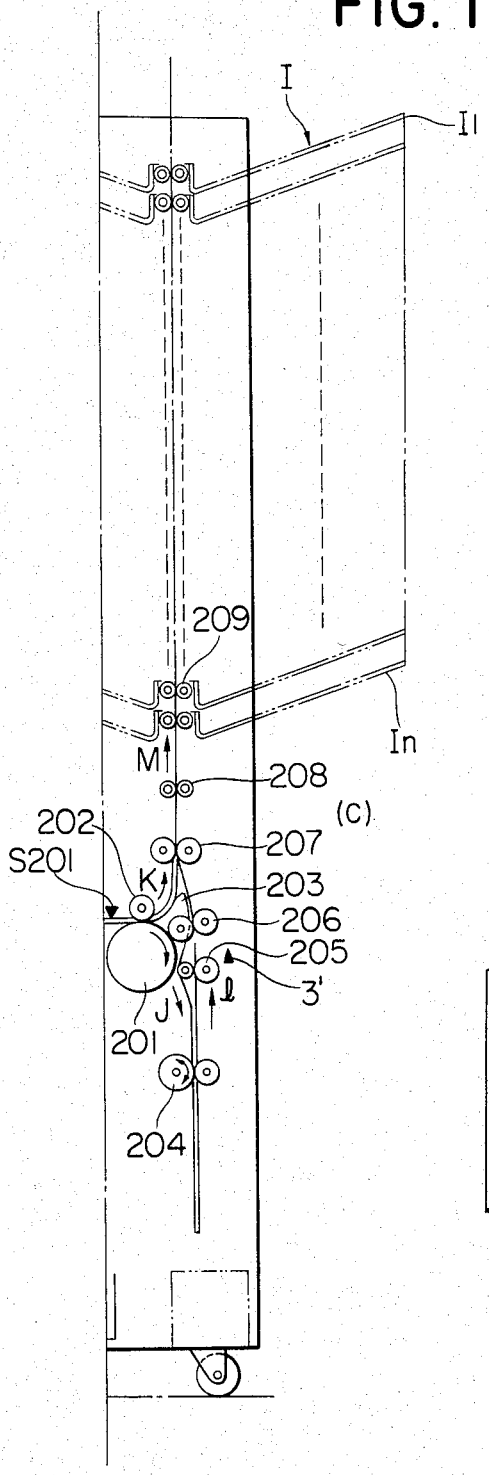
FIG. 1 composed of FIGS. 1A and 1B is a view showing the structure of a copying machine according to an embodiment of the present invention.
Figure 1A:
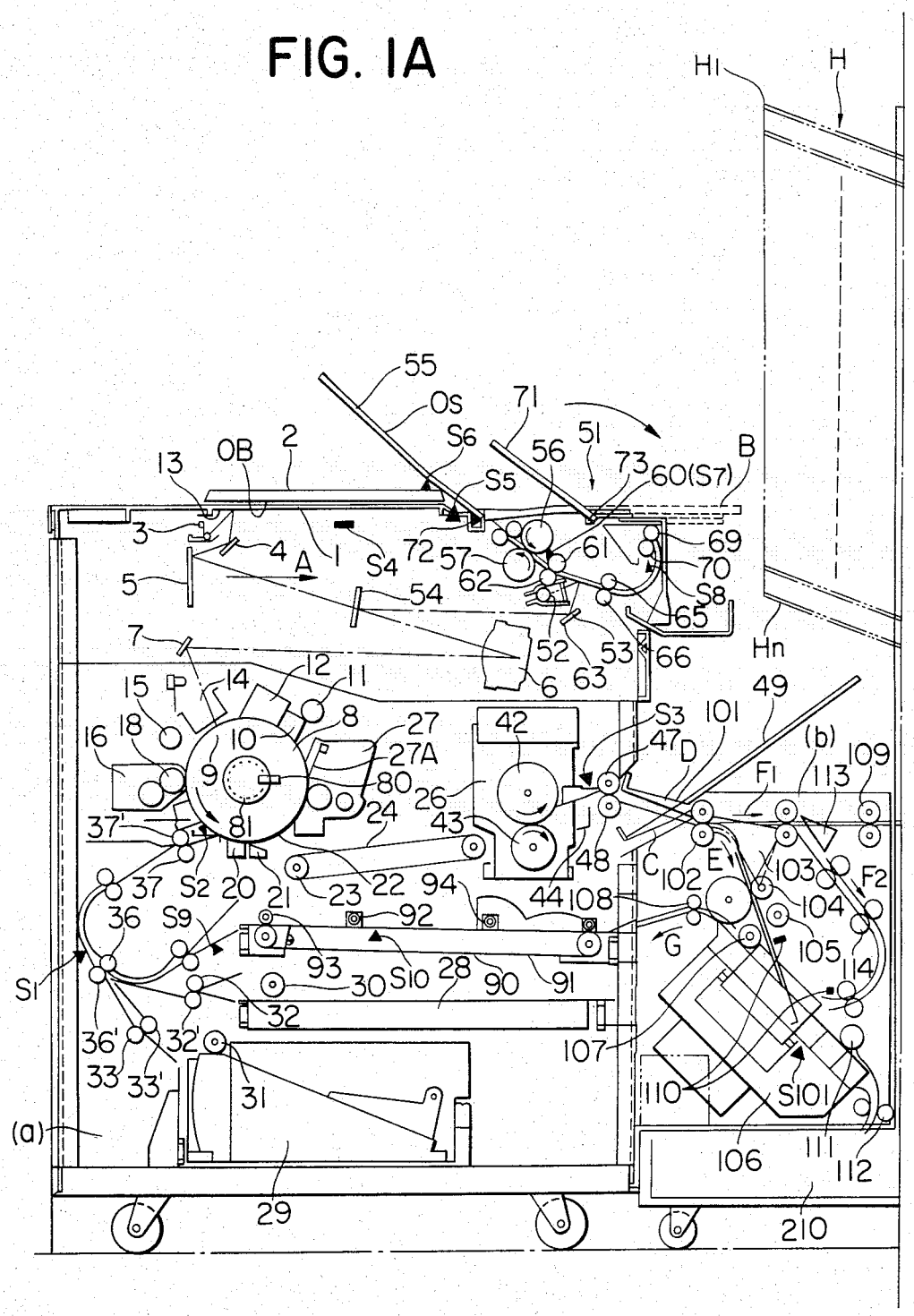

The present invention will now be described in detail with reference to the drawings. FIG. 1 is a sectional view of an electrographic copying machine of the powder developing transfer type according to an embodiment of the present invention.

Referring to a copying machine main body (a) in FIG. 1, a book original OB is placed on a transparent original table 1 with its leading edge aligned with a reference position. The original OB is held by an original cover 2. Below the original table 1 are arranged a lamp 3, first and second movable mirrors 4 and 5, a stationary in-mirror lens 6, a mirror 7, and a photosensitive drum 8 at the positions shown in the figure. When a copy start button (not shown) is depressed, the photosensitive drum 8 starts rotating counterclockwise to be charged and exposed by chargers and a lamp to be described later. Simultaneously, the lamp 3 and the first and second movable mirrors 4 and 5 as a movable part of the optical system moves in the direction indicated by arrow A. More specifically, in response to an exposure start signal generated upon rotation of the photosensitive drum 8 through a predetermined angle, the lamp 3 and the first movable mirror 4 start moving from the positions indicated by the solid lines to the right at a velocity which is the same as the peripheral velocity of the photosensitive drum 8. At the same time, the second movable mirror 5 starts moving from the position indicated by the solid line to the right at a velocity half that of the first movable mirror 4 and the lamp 3. Light from the image on the original OB illuminated by the lamp 3 is guided to form an image on the photosensitive drum 8 by an exposure unit 9 by the optical system consisting of the first and second movable mirrors 4 and 5, the in-line mirror lens 6, the mirror 7 and the like. When exposure is completed in this manner in accordance with the size of the original OB, the lamp 3 and the first and second movable mirrors 4 and 5 stop moving to the right and return to the left. A predetermined desired number of copies specified by a button are produced by repeating the above procedures. Thereafter, the lamp 3 and the first and second mirrors 4 and 5 stop at the positions indicated by the solid lines. The return velocity to the left is far greater than the velocity of movement of these members to the right so as to improve the copying efficiency.

A photosensitive layer of the photosensitive drum 8 is covered with a transparent insulating layer. During counterclockwise rotation of the photosensitive drum 8, it is subjected to light from a lamp 11 and a strong AC electric field by an AC charge remover 10 to which an AC high voltage is supplied from a high-voltage source (not shown). Charge on the surface of the insulating layer and the internal photosensitive layer is thus removed. A positive, high DC voltage from a high-voltage source (not shown) is supplied to a primary charger 12 to positively charge the surface of the photosensitive drum 8. When the corresponding surface portion of the photosensitive drum 8 reaches the exposure unit 9, an image from an illumination unit 13 is slit-exposed and AC charge removal by an AC charge remover 14 to which a high AC voltage is supplied from another high-voltage source (not shown) is performed. The entire surface of the photosensitive drum 8 is then exposed by a lamp 15 to form an electrostatic latent image thereon. When the image reaches a developing unit 16, the image on the photosensitive drum 8 is visualized with a developer magnetically attracted to developing rollers 18. A transfer sheet P from a paper feeder is then brought into tight contact with the photosensitive drum 8. The surface of the photosensitive drum 8 is charged by a positive DC voltage from another high-voltage source (not shown) to transfer the visual image on the photosensitive drum 8 onto the transfer sheet P. The transfer sheet P with a transferred image thereon is charge-removed by a separation charge remover 21 supplied with a high AC voltage in order to weaken the attaching force of the transfer sheet P to the photosensitive drum 8. At a separation unit 22, the transfer sheet P is attracted by a separation roller 23 to be separated from the photosensitive drum 8 and is guided to a fixing unit 26 by a conveyor belt 24. Remaining developer on the surface of the photosensitive drum 8 is removed by an edge 27A of a blade cleaner 27 urged thereto. The copying cycle as described above is repeated to produce the number of copies specified by the button (not shown). Charge on the photosensitive layer is removed by charge removal by the AC charge remover 14 and exposure with light from the lamp 15. After rotating through a predetermined angle, the photosensitive drum 8 is in the standby mode.

The transfer sheets P in a cassette 28 or a paper feed deck 29 are stored in the paper feed portion at the lower left position of the machine. Various types of cassettes 28 are prepared in accordance with the various sizes of the transfer sheets P and are used as needed. The paper feed deck 29 is also constructed such that transfer sheets of appropriate size may be fed by a simple operation. Irrespective of the amount of the transfer sheets P stored in the cassette 28 or paper feed deck 29, they are urged against pickup rollers 30 and 31, respectively at a predetermined pressure. When the photosensitive drum 8 reaches a predetermined position, one of the pickup rollers 30 and 31 which has been selected by operation of a corresponding button starts rotating to feed the transfer sheet P to the left. Thereafter, the transfer sheet P is fed through a paper feed mechanism beginning with paired rollers 32 and 32'or 33 and 33' and to the position of the photosensitive drum 8 by paired rollers 36 and 36' or 37 and 37'. The transfer sheet P is brought into tight contact with the image formed on the surface of the photosensitive drum 8 and the image is transferred to it by charging operation of the transfer charger 20. The transfer sheet P on which the image is transferred is fed out by the separation charge remover 21 and is separated from the photosensitive drum 8 at the separation unit 22. The transfer sheet P is then supplied to the fixing unit 26 by the conveyor belt 24. At the fixing unit 26, the transfer sheet P with a nonfixed image thereon is passed between a pair of rollers 42 and 43 which rotate at the same velocity in contact with each other. The transfer sheet P is thus subjected to a predetermined pressure and the image thereon is fixed. The transfer sheet P is guided to a charge remover 44 to remove any charge remaining thereon and is then fed out onto a feed out tray 49 by feedout rollers 47 and 48.

An automatic feeder 51 at the upper right portion of the machine has an optical system which consists of a lamp 52, a stationary mirror 53 and a movable mirror 54. The movable mirror 54 is arranged such that it may not interfere with the optical paths of the lamp 3 and the first and second movable mirrors 4 and 5 which move during the copying operation as has been described above. When the lamp 3 and the first and second movable mirrors 4 and 5 are stopped at the positions indicated by the solid lines, the movable mirror 54 stops at the position indicated by the solid line to form an automatic feeder optical path involving the lamp 52, the stationary mirror 53, the movable mirror 54, the in-mirror lens 6, and the stationary mirror 7.

When sheet originals OS are stacked on a sheet original table 55, an uppermost sheet original OS' is separated from the remaining originals and is fed forward by separation/feed rollers 56 and 57. When a detecting element 60 detects the leading edge of the uppermost sheet original OS', the original stops at its position. When the photosensitive drum 8 rotates to a predetermined position, the uppermost sheet original OS' is irradiated with light from the lamp 52 and is conveyed between a guide glass 63 and a guide plate 64 in synchronism with the image-forming surface portion of the photosensitive drum 8 by paired rollers 56 and 57, and 61 and 62. Thus, the image of the sheet original OS' is formed on the photosensitive drum 8 through the stationary mirror 53, the movable mirror 54, the in-mirror lens 6, and the stationary mirror 7. The sheet original OS' is then fed to an original tray 71 by paired rollers 65 and 66, and guides 67 and 68, and feedout rollers 69 and 70. A copying cycle as described above is repeated until the sheet originals OS on the sheet original table 55 have all been copied.

The sheet original table 55 and the original tray 71 are rotatably supported by shafts 72 and 73, respectively. When the automatic feeder is used, the sheet original table 55 and the original tray 71 are fixed in position by stoppers (not shown). When the automatic feeder is not used, the sheet original table 55 and the original table 71 are rotated clockwise to be located at positions indicated by B and may be used as operation tables. A fan is also incorporated to cool the guide glass 63 which is heated by the lamp 52.

With the automatic feeder as described above, an elongate original may be copied. Thus, a cassette of large size may be used. In the example shown in the drawings, the storage section of the cassette 28 of large size is located at a portion of the machine expanded due to incorporation of the automatic feeder, thus improving the space factor of the machine.

In order to copy in a different size using a copying machine of the configuration as shown in the drawings, the two types of basic operations indicated below must be performed:

(1) Modification of the optical path length by movement of the lenses and mirrors of an image-forming system, replacement of the lenses, or movement of mirrors.

(2) Modification of relative speed between movement of the photosensitive drum and scanning speed of the original.

When the automatic feeder is used, copying in a different size is performed using the automatic feeder optical system in the following manner. While the lamp 52 and the mirror 53 are fixed in position as shown in the figure, the movable mirror 54 and the in-mirror lens 6 are moved to predetermined positions in accordance with a desired size. The velocities of the separation/- feed rollers 56 and 57, the rollers 61, 62, 65 and 66, and feedout rollers 69 and 70 are changed such that a sheet original convey velocity $V1 = V/n$ where V is the rotational velocity V of the photosensitive drum 8 and n is a magnification factor. The two basic operations as described above are performed.

In order to set a reference control timing of the copying cycle as described above, drum clock pulses DCK are generated by a clock disc 81 rotating together with the photosensitive drum 8, and a sensor 80 for optically detecting the clock point on the clock disc 81. A sensor S1 detects a pickup error or the like of the transfer sheet from the cassette 28 or the paper feed deck 29. A sensor S2 detects jamming or a ramp of the transfer sheet in the vicinity of the transfer unit. A sensor S3 detects jamming of the transfer sheet in the vicinity of the fixing unit and the feedout unit. A sensor S4 detects the registering state of the transfer sheet at the transfer unit. A sensor S5 detects the setting state of the sheet original tray 55 at the automatic feeder. A sensor S6 detects the presence or absence of the sheet original on the tray 55. A sensor S7 such as the detecting element 60 detects the feed timing and a ramp of the sheet original. A sensor S8 detects jamming of the sheet original at the feedout section of the automatic feeder. A sensor S9 detects the transfer sheet in the both sides mode to start the optical system. A sensor S10 temporarily stops the transfer sheet. The sensors S1 to S10 detect changes in the amount of light received due to passage of the original or movement of objects and produces corresponding outputs.

Following the description of a copying machine main body (a), the mode of operation of a both sides unit (b) will now be described. In the normal mode except for the both sides mode and the sort mode, the transfer sheet fed out by the feedout rollers 47 and 48 of the copying machine main body (a) is fed out onto the feedout tray 49 since a feedout switch level 109 is at the lower position indicated by C. However, in the both sides mode, the feedout switch lever 101 is at the upper position indicated by D. Therefore conveying rollers 102 and a conveying path switch cam 103 feed the transfer sheet in the direction indicated by E. The transfer sheet is supplied to a transfer sheet intermediate tray 106 by conveying rollers 104 and 105 and is registered in accordance with the size. In the copying operation of the front side of the transfer sheet in the both sides mode, the transfer sheets fed out from the copying machine main body (a) are all housed in the intermediate tray 106 once. Before these transfer sheets are housed in the intermediate tray 106, they are fed out by a charge remover 110. In the copying operation of the back side of the transfer sheet, the sheet is supplied to a both side conveying section 90 of the copying machine main body (a) through a conveying path G by a feed roller 107 and conveying rollers 108. In the both sides conveying section 90, the transfer sheet is fed to a refeed roller 93 by a conveyor belt 91 and a feed roller 92. The refeed roller 93 rotates at a predetermined timing to feed the transfer sheet to the feeder of the copying machine main body (a) to form an image on its back side. In order to feed out the transfer sheet on the back side of which an image is also formed, the feedout switch lever 101 at the position D during the copying operation on the front side is switched to the position C so as to allow housing of the transfer sheet after forming an image on its back side in the feedout tray 49.

In order to convey the transfer sheet from the copying machine main body (a) to a sorter (c), the feedout switch lever 101 is set the position D to actuate the conveying path switch cam 103, thereby conveying the transfer sheet in the direction indicated by F, that is, toward the sorter. A sensor S101 detects the transfer sheet in the intermediate tray. Drive rollers 111 and 112 serve as feedout rollers for housing the transfer sheets in the intermediate tray 106 into a housing box 210. The both sides unit (b) has a transfer sheet conveying path which allows overlay or multi copying, that is, formation of an image on a transfer sheet on which another image is already formed. In order to perform overlay copying, the transfer sheet on which the image is already formed is conveyed in the direction indicated by F1 by the conveying path switch cam 103, is conveyed in the direction indicated by F2 by another conveying path switch cam 113, and is then housed in the intermediate tray 106 by a drive roller 114. The transfer sheet is housed in the intermediate tray 106 with its surface with an image facing down, so that overlay recording may be performed on the same side after refeed.

The sorter (c) has bins H and I at the left and right sides. The transfer sheet is housed in appropriate bins H and I by control of bin shift rollers 209. The transfer sheet conveyed in the direction F1 of the both sides unit (b) is housed in each of the bins H and I of the sorter (c) by feedout rollers 109 through inlet rollers 202 and 201. The sorter of the copying machine of the present invention has a reversal control section 3' for reversing the transfer sheet. By controlling the reversing operation of the transfer sheet from the copying machine main body (a), the transfer sheet housed in the bins H and I of the sorter may be automatically made to face down or up.

In order to house the transfer sheets from the copying machine main body (a) facing down in all the bins H and I, the corresponding button (not shown) of the copying machine main body (a) is depressed. Then, the transfer sheet after copying operation is fed out with its image side facing up. The transfer sheet is conveyed through the inlet rollers 202 and 201 of the sorter (c). The convey path switch cam 203 is controlled to convey the transfer sheet in the direction indicated by K and is sequentially housed from the uppermost bin H1 toward the lowermost bin Hn of the bins H facing down. When the bins H are full up to the lowermost bin Hn, the bins I are used in a similar manner to house the transfer sheets through the convey path indicated by K. The transfer sheets are thus housed facing up in the bins I. The last transfer sheet is housed in the lowermost bin In. Therefore, the transfer sheets may be reversed by the reverse control section 3'.

In order to reverse a transfer sheet, a sensor S201 at the inlet of the sorter detects the trailing edge of the Hnth transfer sheet to switch the conveying path switcn cam 203 so as to convey the subsequent transfer sheets in the direction indicated by J to be housed in the bins I. Subsequently, the transfer sheet is then conveyed downward by a time-up roller 204 rotating clockwise and is then conveyed through conveying rollers 205 and 206 in the direction indicated by l by the time-up roller 204 rotating counterclockwise after a predetermined time interval. When the leading edge of the I1th transfer sheet is detected by the sensor S201, the time-up roller 204 immediately starts rotating clockwise. After a predetermined time interval from detection of the trailing edge of the same transfer sheet, the time-up roller 204 rotates counterclockwise until the sensor S201 detects the leading edge of the next (I2th) transfer sheet. By the control operation of the reverse control section 3' described above, the side of the transfer sheet conveyed in the direction indicated by M is reversed and is housed to face down in the bin I1. In order to house the transfer sheets to face up in the respective bins H and I, the transfer sheets are reversed before they are housed in the bins H. The housing box 210 stores the transfer sheets.

The copying machine of the present invention consists of the copying machine main body (a), the both sides unit (b) and the sorter (c). Automatic copying may be performed quite effectively by suitably combining these units.

For example, in the book mode described with reference to FIG. 2, assume that a predetermined number of copies are produced after instructing both sides copying and setting the number of copies at the control unit (not shown). When the copy start button (not shown) is depressed, the copying machine main body (a), the both sides unit (b) and the sorter (c) are operated. If the transfer sheet is remaining in the intermediate tray 106 of the both sides unit (b), it is detected by the sensor S101 which then drives the drive rollers 111 and 112. The transfer sheet is then fed out to the housing box 210. The transfer sheet remaining in the intermediate tray 106 may be housed in the feedout tray 49 through the convey path of the copying machine main body (a). After this series of operations, the copying machine main body (a) can start operating. In order to produce both sides copying of a predetermined number of transfer sheets for the same original in the book mode, after the image is formed on one side of each of the transfer sheets supplied from the cassette 28 or the paper feed deck 29, the transfer sheets are housed in the intermediate tray 106 of the both sides unit (b). When the image of another original is to be formed on the back side of each of the transfer sheets, the transfer sheets are refed from the intermediate tray 106. Since a proper instruction has been supplied to the sorter (c), the feedout switch lever 101 is at the position D, and the conveying path switch cam 103 is controlled to convey the transfer sheets in the direction F. Therefore, the transfer sheets which face down are sequentially housed in the bins H1 to Hn and I1 to In. In order to house the transfer sheets with their sides with images facing down in the bins H1 to Hn, the transfer sheets are reversed by the reverse control section 3' of the sorter (c). The transfer sheets are conveyed without reversing them to the bins I1 to In to house them facing down, while the reverse control section 3' is used to house the transfer sheets facing up in the bins H and I. When the desired number of copies exceeds the number of bins, all the extra transfer sheets may be housed in the feedout tray 49. Alternatively, if the sorter has been selected while setting the number of copies to be produce, then a setting of the number of copies exceeding the number of bins may be inhibited.

Figure 3:
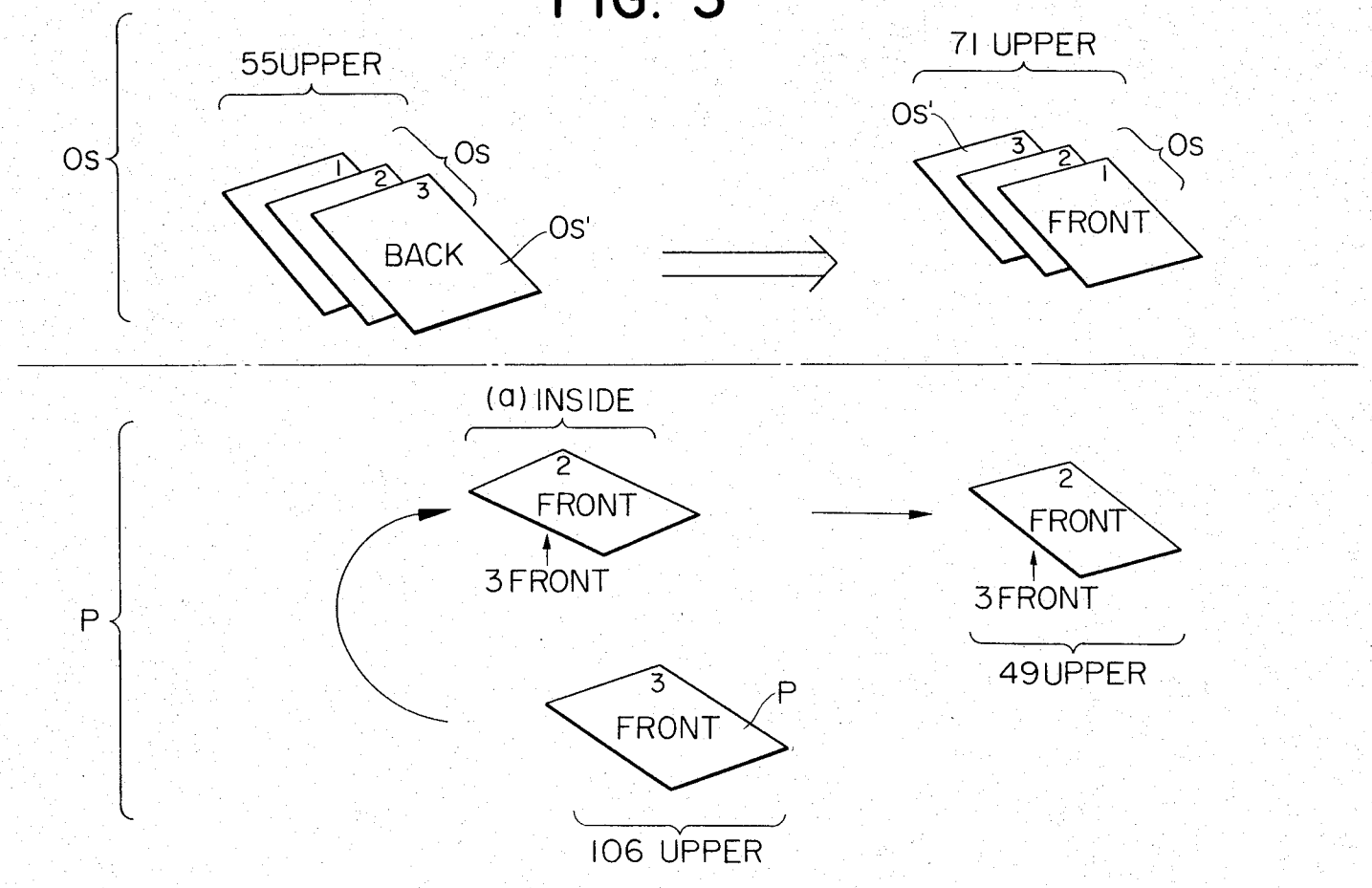
FIG. 3 is a representation showing the sequence of the sheet mode of the copying machine shown in FIG. 1.

The mode of operation for automatic both sides copying in the sheet mode will now be described with reference to FIG. 3. In the sheet mode of the present invention, the uppermost original is separated and is copied. As shown in FIG. 3, the third original from the uppermost one of the sheet originals OS on the sheet original tray 55 is first copied. The transfer sheet P after copying is conveyed and housed in the intermediate tray 106. The image of the second sheet original OS is to be formed on the back side of the transfer sheet on which the image of the third sheet original OS is formed. Therefore, the transfer sheet P in the intermediate tray 106 is refed for copying on its back side. The transfer sheet P with images formed on its both sides is housed in the feedout tray 49 or the sorter (c). When the image of the last sheet original OS is to be formed, a transfer sheet is not fed to the intermediate tray 106, so that images of the first sheet original may not be formed on the different sides of the transfer sheets. Care must be taken to prevent this only when the originals number an odd number. Therefore, the both sides copy mode is modified in accordance with the determination result obtained by discriminating if the originals number an odd or even number.

In accordance with the present invention, in order to increase the copying speed for both sides copying, the sensor S10 is arranged on the both sides conveying section 90 of the copying machine main body (a). Thus, the sequentially conveyed transfer sheets are temporarily stopped to examine the feed timings. The refeed roller 93 is arranged along the both side conveying section 90 to correct any ramp of the transfer sheet.

According to the present invention, the sensor S9 is arranged behind the refeed roller 93 of the both sides conveying section 90 so as to control the moving start timing of the movable optical system in the book mode. A charge remover 110 is arranged at the outlet port of the conveying path for housing the transfer sheet from the intermediate tray 106 so as to facilitate refeed of the transfer sheet for copying on the back side thereof.

In the copying machine of the present invention, an image of another original may be overlaid on the side of a transfer sheet on which the image of another original is already formed. The book mode and the sheet mode may be selected as desired to allow automatic overlay copying such that different names, addresses and the like are printed on sheets of a predetermined format such as stock certificates, shipping slips of department stores, and the like. A predetermined number of transfer sheets on which a predetermined format is printed in the book mode are housed in the intermediate tray 106 in the direction E in FIG. 1. Another sheet original for overlaying such as a list of names is placed on the sheet original table 55. Overlay copying is performed sequentially on the transfer sheets refed from the intermediate tray 106.

Figure 4A:
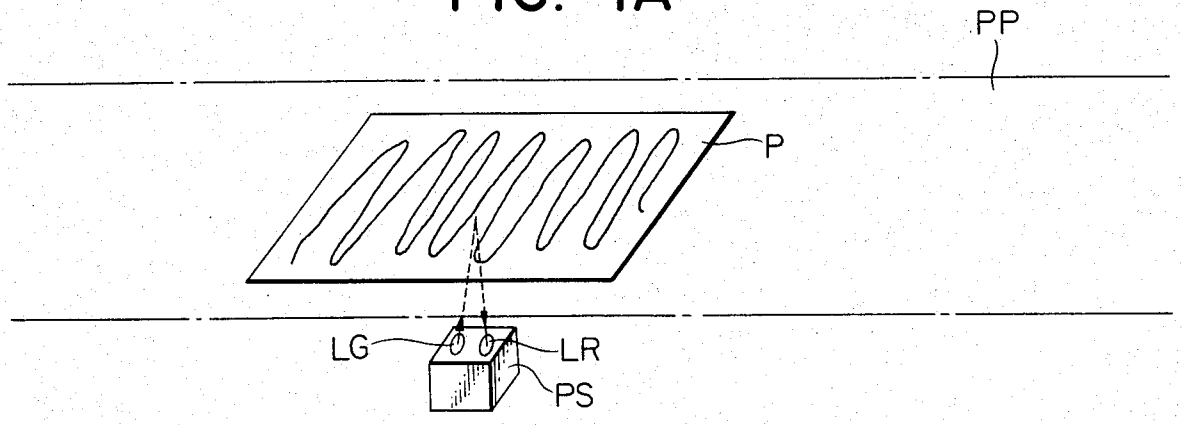
FIGS. 4A and 4B are a perspective view and a circuit diagram, respectively, showing the detection mode of a conveyed transfer sheet with an image formed thereon and the configuration of the sensor.
Figure 4B:
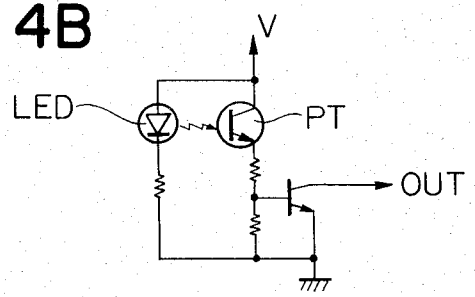
Figure 6A:
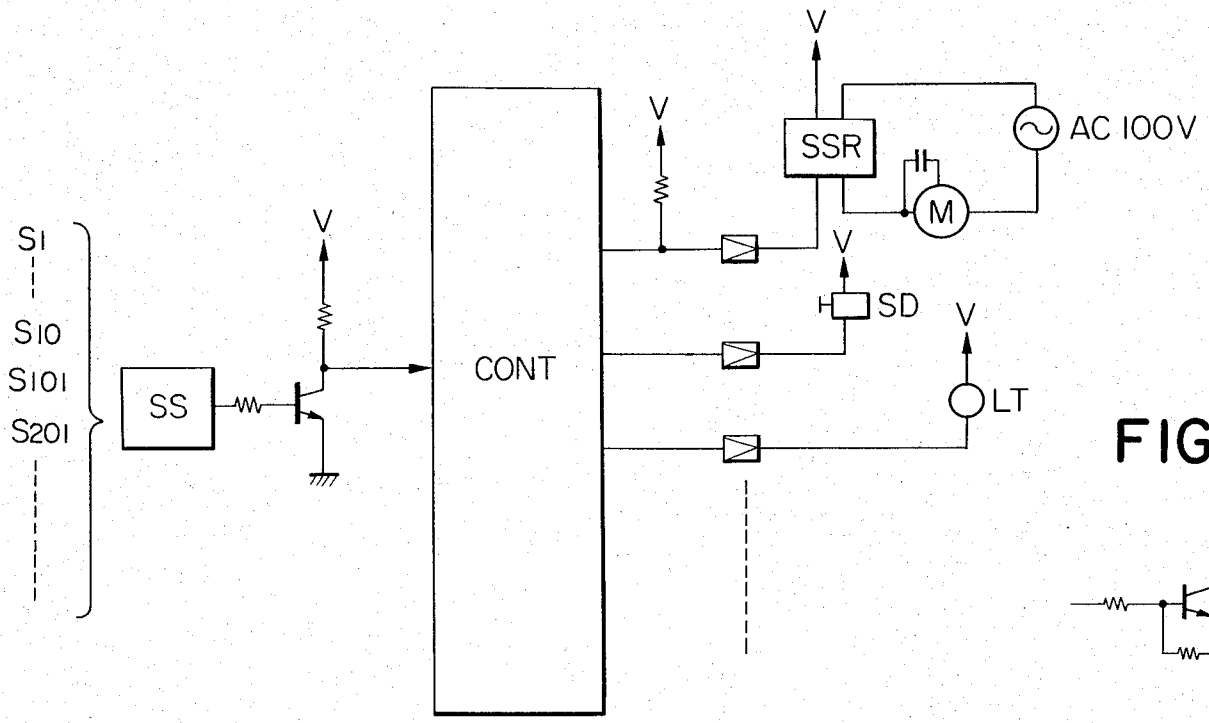
FIG. 6A is a block diagram showing input/output elements of the control circuit and FIG. 6B is a circuit diagram of an amplifier of the copying machine shown in FIG. 1.
Figure 6B:
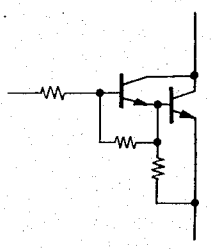

Prior to the description of the mode of operation of the copying machine of the present invention for performing such overlay copying with reference to the flowcharts and timing charts, the configuration of the sensor for controlling the transfer sheet conveying operation in the machine of the configuration shown in FIG. 1 is shown in FIGS. 4A and 4B, the configuration of the control section incorporating a microcomputer is shown in FIG. 5, and the configuration of the I/0 port of the control section is shown in FIG. 6. In the copying machine of the present invention, as shown in FIG. 4A, a sensor PS for detecting the passage of the transfer sheet P conveyed on a convey path PP is opposed to the conveying path PP. Light emitted by a light-emitting element LG and reflected by the transfer sheet P is detected by a light-receiving element LR. The light-emitting element LG and the light-receiving element LR may comprise a light-emitting diode LED and a phototransistor PT, respectively, in the circuit configuration as shown in FIG. 4B. The control section for controlling the various units of the copying machine of the present invention may comprise a microcomputer as shown in FIG. 5. As is well known, the microcomputer has a read-only memory (ROM), a random access memory (RAM), and an arithmetic control circuit (ACC) The microcomputer has inlet ports A to F and output ports G to L and produces control output signals from the output ports G to L. To the control section are connected, as shown in FIG. 6 A, the sensors S1 to S10, S101 and S201; and loads such as a motor M, a solenoid SD, a latch circuit LT and the like. These loads are connected to the control section through amplifiers as shown in FIG. 6B.

The control operation of the copying machine of the present invention will be described with reference to the flowcharts in FIGS. 7 and 8 and the timing charts in FIGS. 9 and 10.

For performing copying in the book mode, the both sides copying button and the sorter selection button at the operation section are depressed so that a predetermined number of both sides copied transfer sheets are produced and are stored in the sorter.

Figures 7, 7C:
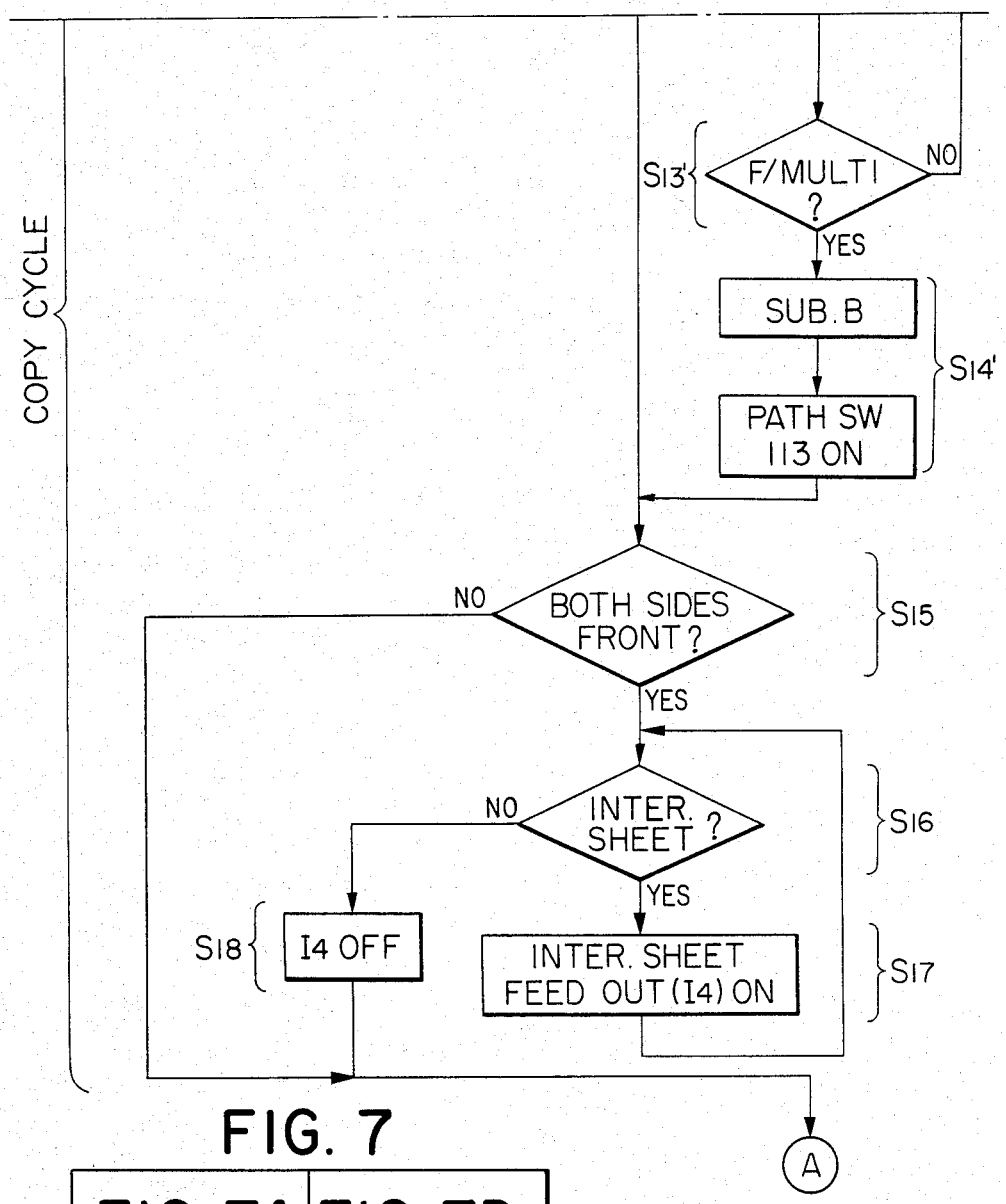
FIGS. 7 composed of FIGS. 7A to 7E and FIG. 8 composed of FIGS. 8A to 8D are flowcharts of the mode of operation of the copying machine shown in FIG. 1.
Figure 7A:
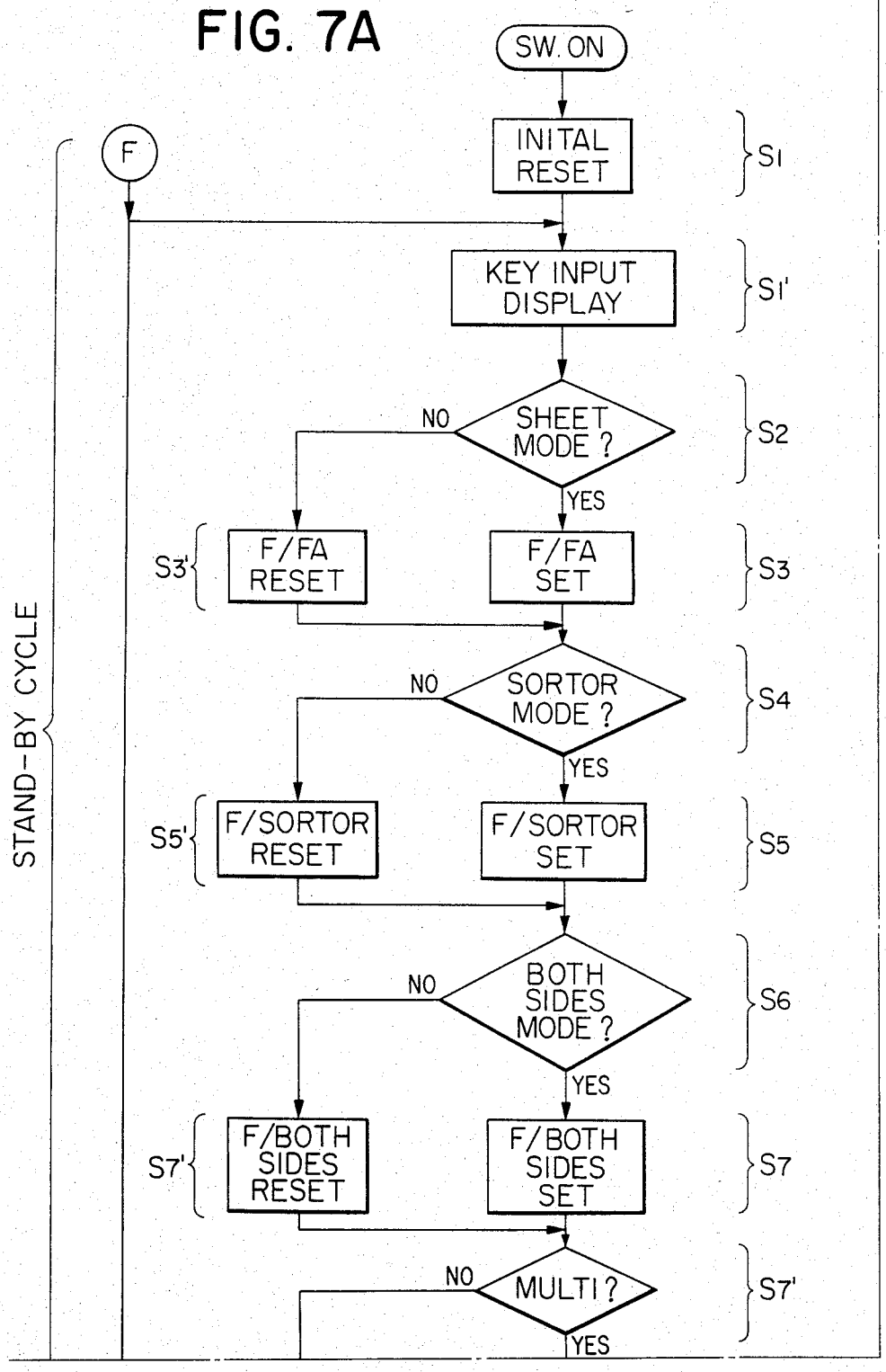
Figure 7B:
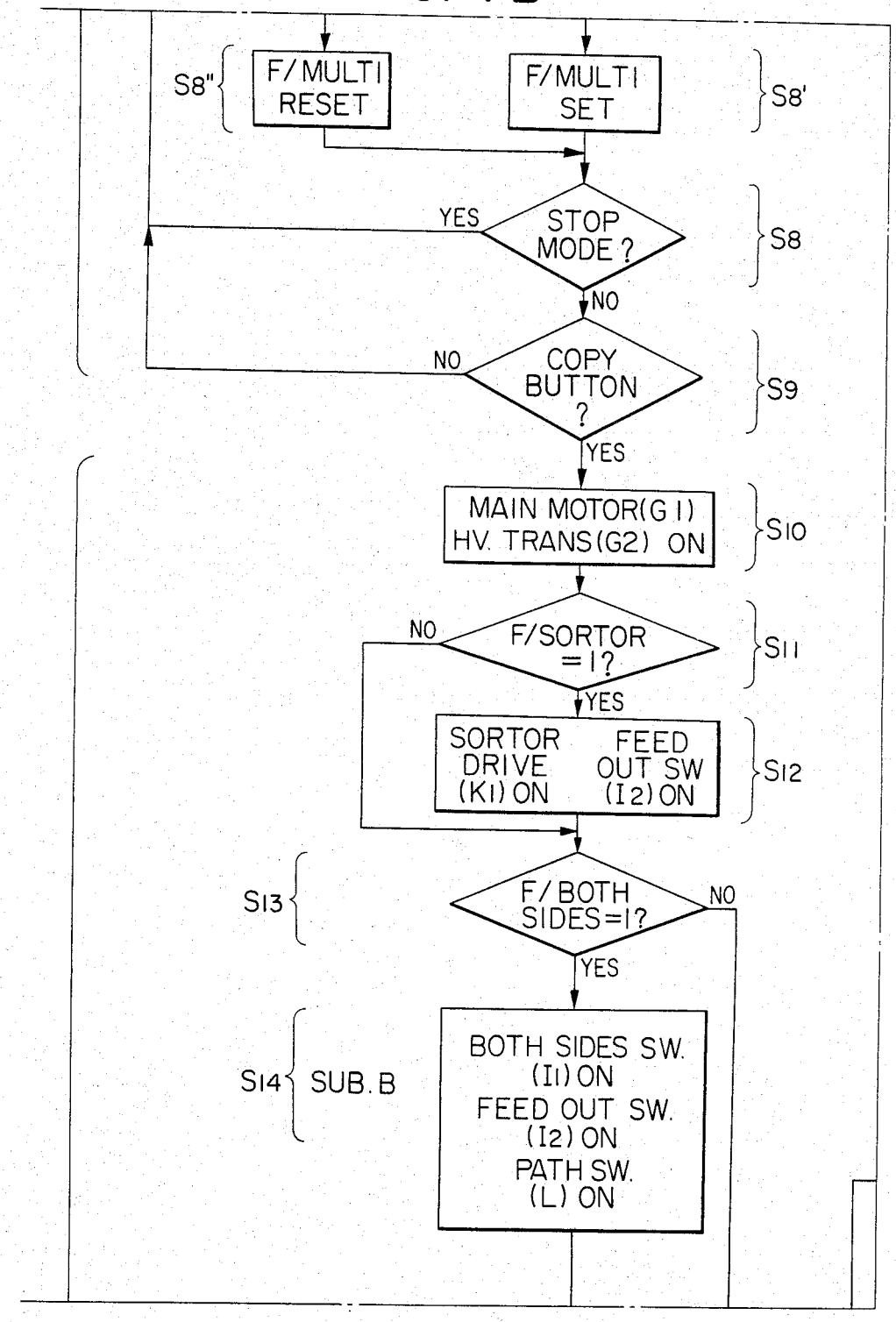
Figure 7D:
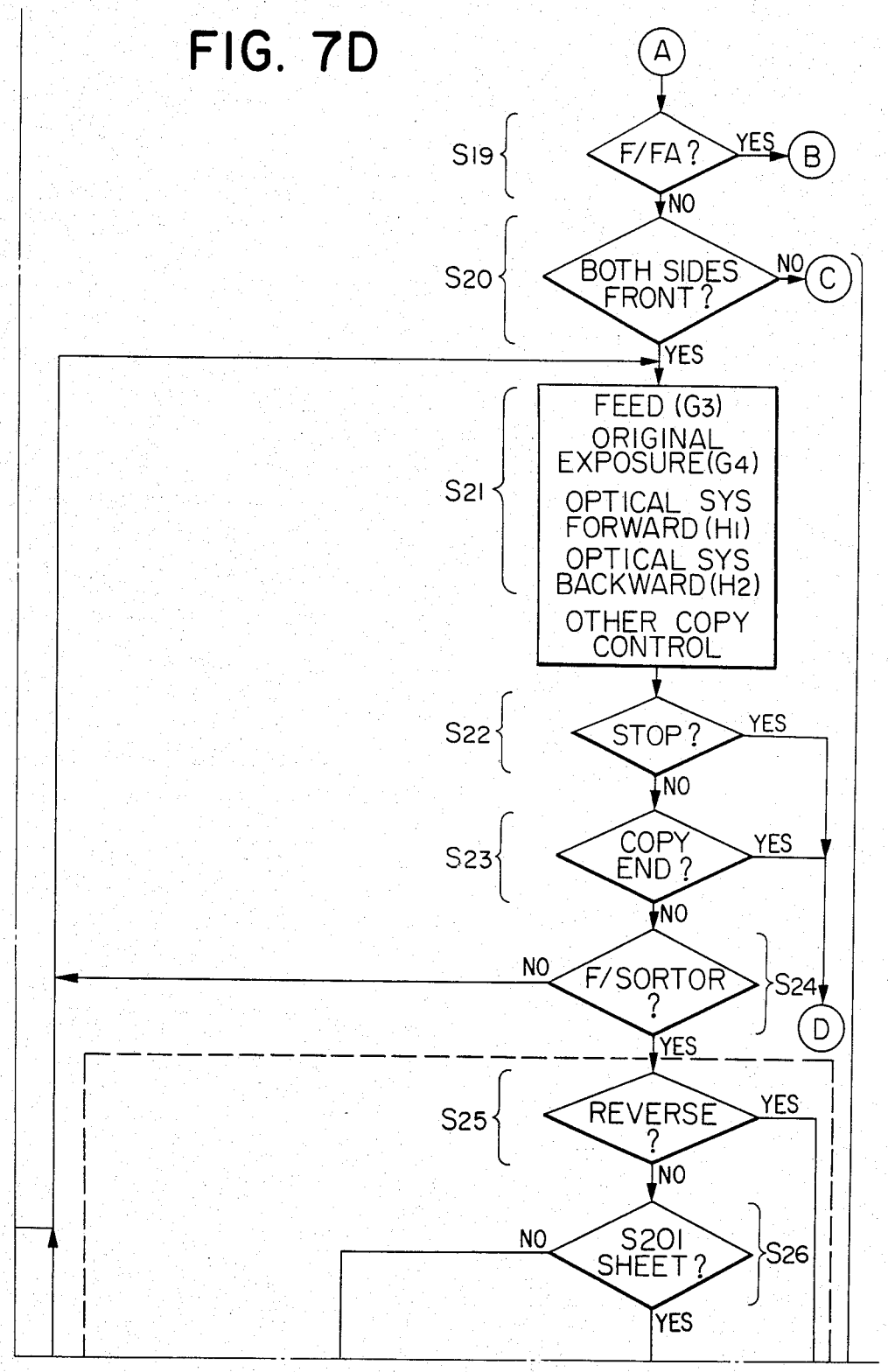
Figure 7E:
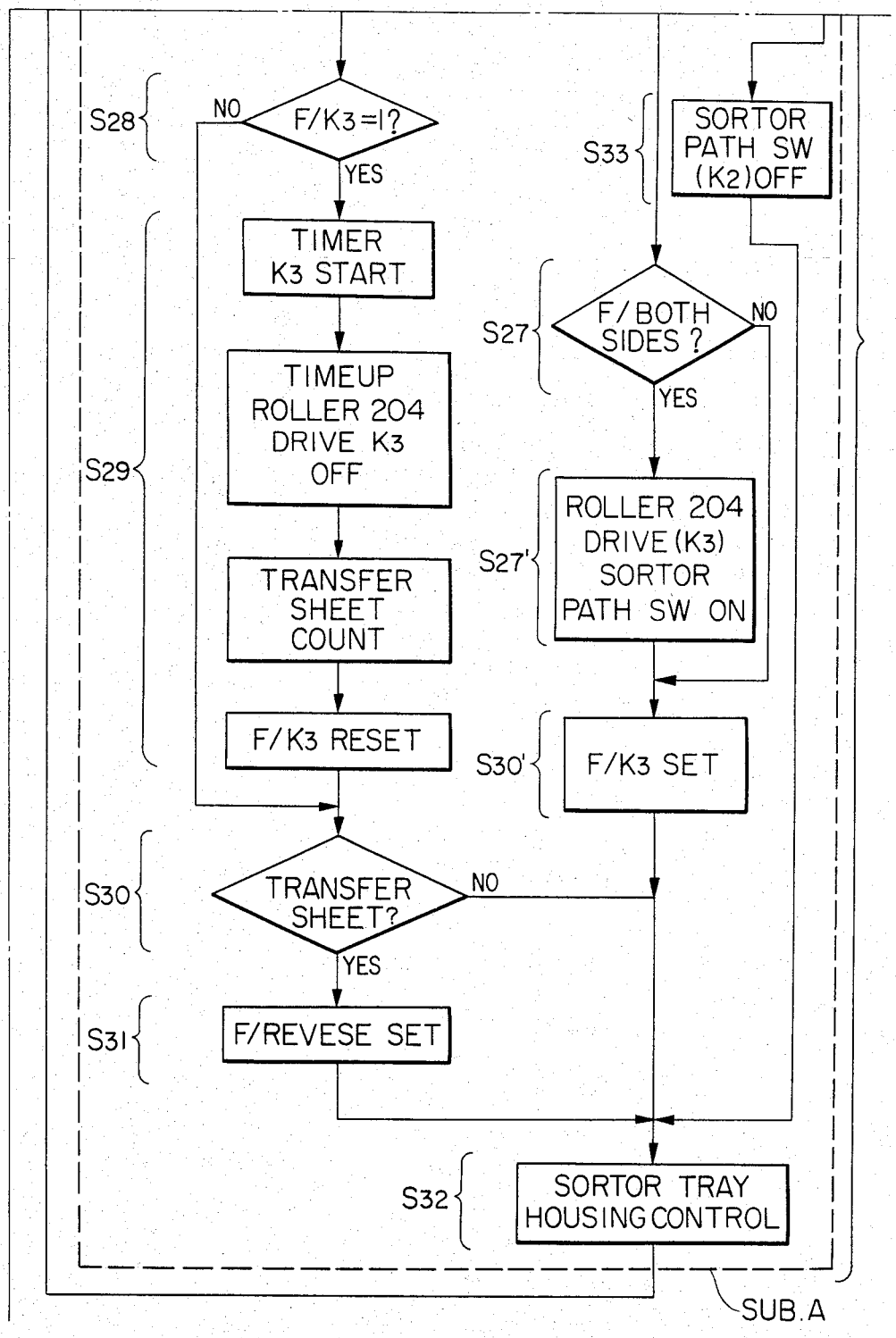

When the power switch (not shown) of the copying machine main body is turned ON, initial setting of the control section is performed in step S1 in the flowchart of FIG. 7. More specifically, the RAM is cleared and the input/output ports of the control section are reset. In step S1', key input and display are performed; various displays are performed at the operation section, and input data through the copy start key, the copy number set key and other instruction keys is controlled. In step S2, it is discriminated by the limit switch of the sensor S5 if the sheet original tray is set to the sheet code mode. If YES in step S2, the flag F/AF is set in step S3. On the other hand, if NO in step S2, the flag F/AF is reset in step S3'. It is then discriminated in step S4 if the sorter is selected. If YES occurs in step S4, the flag F/SORTER is set in step S5. On the other hand, if NO occurs in step S4, the flag F/SORTER is reset in step S5'. In step S6, it is discriminated if the both sides mode is selected. If YES occurs in step S6, the flag F/BOTH SIDES is set in step S7. If NO occurs in step S6, the flag F/BOTH SIDES is reset in step S7'. For the current case, assume that the flags F/SORTER and F/BOTH SIDES are set. In step S7", it is discriminated if the overlay or multi copying is selected. If YES occurs in step S7", the flag F/MULTI is set in step S8'. If NO occurs in step S7", the flag F/MULTI is reset in step S8". Assume that the flag F/MULTI is not set. In step S8, it is discriminated if the copying machine is in the stop mode; the state such as no paper, no developer or the like is detected. If YES occurs in step S8, the sequence returns to step S1'. If NO occurs in step S8, the sequence advances to step S9. In step S9, it is discriminated if the copy start button has been depressed. If NO occurs in step S9, the sequence returns to step S1'. If YES occurs in step S9, the sequence advances to step S10.

The operation up to this point is the preparation for the actual copying cycle, that is, the standby cycle.

When the copy start button is depressed, the main motor, the high-voltage transformer and the like of the copying machine main body (a) are turned ON in step S10. In step S11, it is discriminated if the flag F/SORTER is "1". If YES occurs in step S11, the sorter is driven and the feedout switch lever 101 is moved to the position D in step S12. If NO occurs in step S11, the sequence jumps to step S13. In step S13, it is discriminated if the flag F/BOTH SIDES is "1". If YES in step S13, the sequence advances to step S14.

It is assumed here that the flag F/BOTH SIDES is set or "1".

Thus, the sequence advances from step S13 to step S14 wherein a both sides drive signal I1, a feedout switch signal I2, and a convey path switch signal I3 are enabled (ON). Then, the conveying path switch cam 103 is driven to switch the conveying direction of the transfer sheet to the direction indicated by E, that is, toward the intermediate tray to complete the preparation for both sides copying and for the sorter. In step S15, it is discriminated if the current copying is the front side or back side copying. Since the front side is to be copied first in this case, the sequence advances to step S16. In step S16, it is discriminated if a transfer sheet is present in the intermediate tray 106. If YES occurs in step S16, the flow advances to step S17. In step S17, an intermediate feedout signal I4 for actuating the drive rollers 111 and 112 for feeding out the transfer sheet remaining in the intermediate tray 106 into the box 210 is turned ON. Steps S16 and S17 are repeated until all the transfer sheets remaining in the intermediate tray 106 are fed out so that disturbance of the order of both sides copying of desired originals may not be caused by the presence of transfer sheets in the intermediate tray. Although the box 210 is used in the embodiment described above, another means may also be used. For example, if transfer sheets are remaining in the intermediate tray 106 before execution of both sides copying, the transfer sheets in the intermediate tray may be continuously fed to the copying machine main body (a) to be fed out onto the feedout tray 49. At this time, the copying machine main body (a) does not perform copying such as exposure and drives only the conveying system. It is also possible to indicate the presence of the transfer sheets in the intermediate tray so as to allow the operator to remove them. When NO is first obtained in step S16, the intermediate feedout signal I4 is turned OFF in step S18. In step S19, it is discriminated if the flag F/AF is set or the sheet mode is selected. Since the book mode is selected in this case, the flow advances to step S20. In step S20, it is discriminated if the current side to be copied is the front side of a transfer sheet on both sides of which the images are to be formed. If YES occurs in step S20, a paper feed signal G3 for feeding the transfer sheet from the cassette 28 or the paper feed deck 29 is turned ON, and thereafter an original exposure signal G4 for turning the lamp 3 ON is turned ON. Other control signals such as an optical system forward signal H1 are generated. In step S22, it is discriminated if the stop button has been selected (the stop mode is selected), or if no transfer sheet is present. If NO occurs in step S22, the sequence advances to step S23 to compare the desired number of copies to be produced with the number of actually produced copies. When these two numbers coincide or YES occurs in step S23, the flow advances to step S58 as in the case of YES in step S22. If NO occurs in step S23, the sequence advances to step S24. In step S24, it is discriminated if the sorter is selected through the state of the flag F/SORTER. Since the flag F/SORTER is set in this case, the sequence advances to step S25. In step S25, it is discriminated if the flag F/REVERSE is set to see if the reverse control section 3' must be driven. Since the flag F/REVERSE is reset, the flow advances to step S26. In step S26, it is discriminated if a transfer sheet is detected by the sensor S201 of the sorter. In the case of copying on the front side of the transfer sheet on both sides of which images are to be formed, the transfer sheet is first fed to the intermediate tray. Therefore, the transfer sheet is housed in the intermediate tray 106 and does not reach the sensor S201. Therefore, the sequence advances to step S28. In step S28, it is discriminated if the flag F/K3 to be described later is "1". Since the flag F/K3 is reset in this case, the flow advances to step S30. In step S30, it is discriminated if the number of transfer sheets in the sorter coincides with number Hn of the bins H. Since they do not coincide first, the sequence advances to step S32. In step S32, the transfer sheets are housed in the bins H and I. Since the transfer sheet is not present in the sorter in this case, the housing operation is not performed and the flow returns to step S21. The front side copying is repeated until the number of transfer sheets on the front side of which images are formed reaches the desired number, that is, until YES occurs in step S23. When back copying is started after completing front copying, steps S1 to S20 are performed and NO is obtained in step S20 to advance to step S34. Note that steps S16 to S18 are not performed since the images must be copied on the back sides of the transfer sheets. In step S34, the transfer sheets on the front sides of which images are formed and which are fed from the intermediate tray 106 are sequentially fed. In step S35, it is discriminated if the sensor S10 at the both sides conveying path of the copying machine main body detects a transfer sheet. A routine program of steps S41, S43 to S46, S48, S51 and S35 is performed until YES occurs in step S35.

If YES occurs in step S35, the sequence advances to step S36 wherein the feed roller 92 is turned ON. In step S36', the feed roller 92 is rotated for a predetermined time interval to oppose the transfer sheet against the refeed roller 93 to correct the ramp of the transfer sheet. The feed roller 92 is then stopped. A ramp occurring in the transfer sheet during the conveying operation is corrected. After steps S37 and S39 and a predetermined time interval elapses in step S39, the feed roller 92 and the refeed roller 93 are rotated. The flag F/A is a flag which represents the timer for providing the timing of the registration by the refeed roller 93. The flag F/A is reset in step S40. In step S41, the leading edge of the transfer sheet is detected by the sensor S9. In response to this detection result, the flag F/S9 is set and the flow advances to step S42. In step S42, the optical system drive signal H1 is turned ON to turn ON the lamp 3. In step S43, it is discriminated if the stop mode is selected. In step S44, it is discriminated if the copying operation of a desired number of copies is completed. It is then discriminated, in step S45, whether or not if the sorter is selected through the state of the sorter. If NO in step S45, the feedout switch signal I2 is turned OFF to move the feedout switch lever 101 to the position C and to house all the transfer sheets in the feedout tray 49 in step S47. Since the sorter is selected and the flag F/SORTER is set in this case, the flow advances to step S46 to execute a subroutine program of steps S25 to S32. Since the flag F/REVERSE is not set in step S25, the flow advances to step S26 wherein it is discriminated if the sensor S201 detects a transfer sheet. Assume that a transfer sheet on both sides of which images are formed is fed out from the copying machine main body and is supplied to the sorter through the conveying path indicated by F1, the sensor S201 detects the transfer sheet and the flow advances to step S27 to discriminate the state of the flag F/BOTH SIDES. Since the flag F/BOTH SIDES is set in this case, in step S27', the time-up roller 204 of the reverse control section 3' is turned ON and the convey path switch cam 203 is turned ON to feed the transfer sheet in the direction indicated by J. In step S30', the flag F/K3 is set. The flag F/K3 serves to stop driving or clockwise rotation of the time-up roller 204 after a predetermined time interval elapses. When the clockwise rotation of the time-up roller 204 is stopped, it automatically starts rotating counterclockwise. Therefore, the transfer sheet which has been conveyed in the direction indicated by J is conveyed in the direction indicated by I by the counterclockwise direction of the time-up roller 204 after a predetermined time interval for conveying the transfer sheet in the direction J. When the transfer sheet is housed in the bin H of the sorter, its side on which an image is formed faces down. When YES is obtained in step S30, the flag F/REVERSE is set and the flow advances to step S33. In step S33, the sorter convey switch signal K2 is turned OFF to switch the conveying path switch cam 203 of the sorter to convey the transfer sheet in the direction indicated by K. When the transfer sheet is housed in the bin I without passing through the reverse control section 3', its side on which the image is formed faces up in the bin I. In order to house the transfer sheets facing down in the bins H and I, the reverse control section 3' is controlled accordingly. In step S48, it is discriminated if the flag F/S9 is "1". If the copy end is detected by the sensor S9 in step S49, the refeed roller 93 and the feed roller 92 are turned OFF and the flag F/S9 is reset in step S50. Steps S34 to S51 are repeated until there is no more transfer sheet in the intermediate tray. When the last transfer sheet is supplied from the intermediate tray 106, a both sides feed signal J1 is turned OFF. A series of copying operations is performed in this state. When the copy end is detected in step S44, post-rotation of the photosensitive drum 8 is performed to electrostatically clean it. In step S59, the respective units and mechanisms are stopped.

Automatic both side copying operation in the sheet mode will now be described. The mode of operation up to step S19 is the same as that in the book mode. However, since the flag A/AF is set in step S19, the flow advances to step S53. Referring to FIG. 3, the sheet originals OS are placed on the tray 55 with their surfaces to be copied facing down. Assuming that three originals and three transfer sheets P are to be involved as in the case shown in the figure. Then, copying is sequentially performed from the third original. The first original is housed last on the feedout tray 71. When copying is performed in this manner, the order of the originals is not disturbed. As for the transfer sheets, the image is first formed on the third transfer sheet and is housed in the intermediate tray 106. For the second original, the third transfer sheet is fed from the intermediate tray 106 to allow copying of an image on the opposite side of the transfer sheet on which the image is not formed yet. The transfer sheet is then housed in the feedout tray 49. For copying the last original, after the image is formed on the second transfer sheet, the transfer sheet is not fed to the intermediate tray 106 but is directly fed in the feedout tray 49.

Figures 8, 8D:
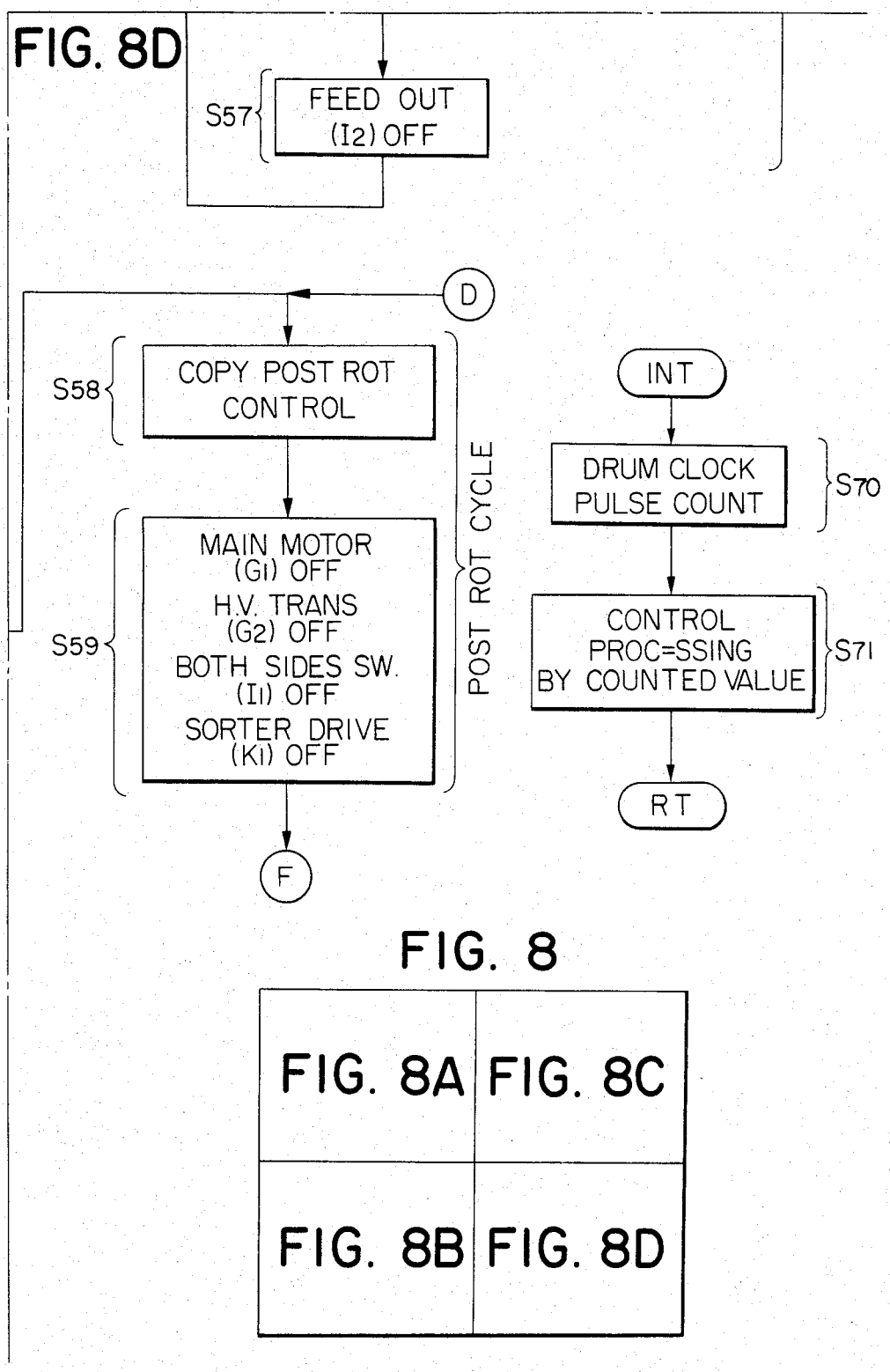
Figure 8A:
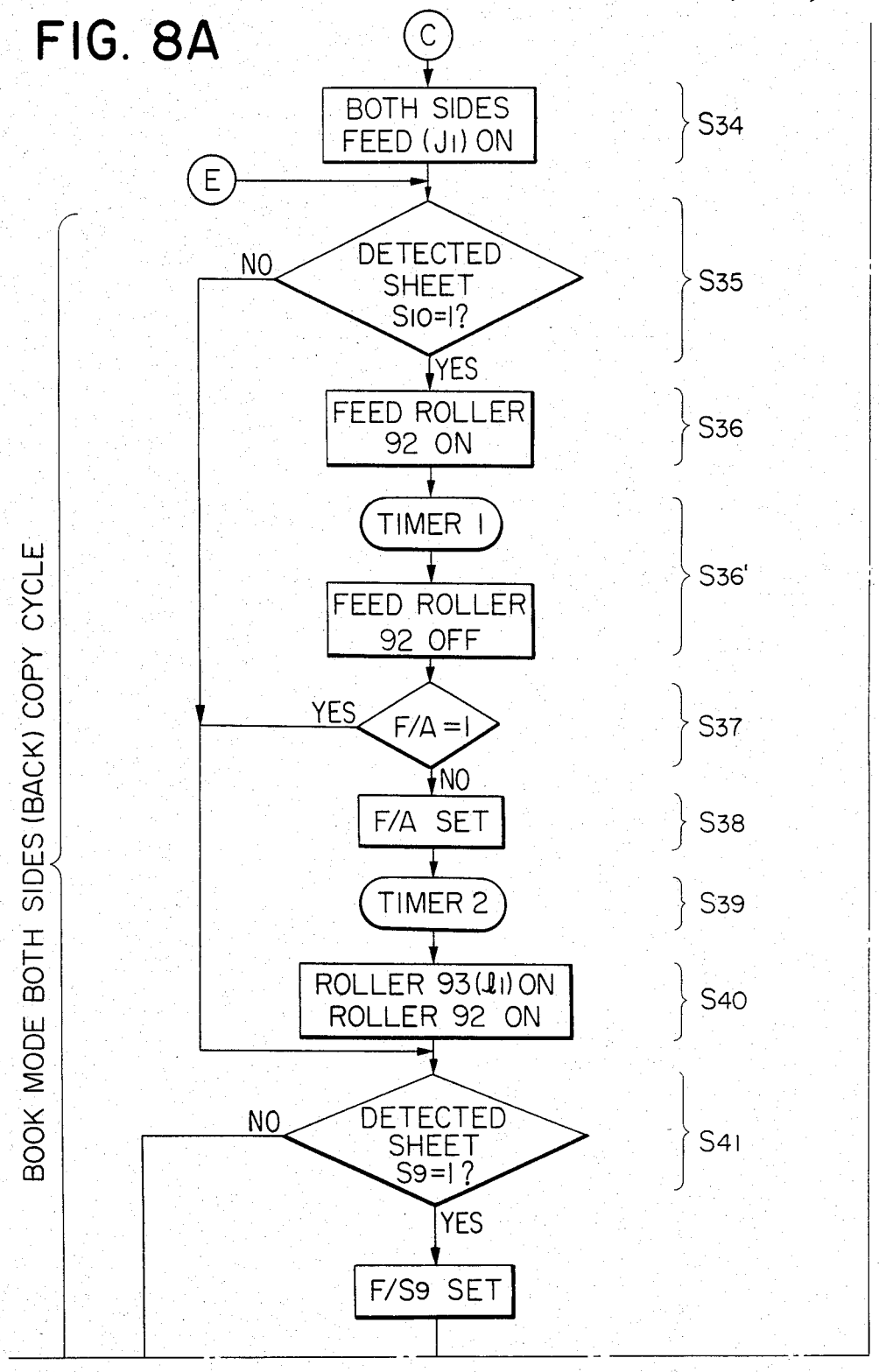
Figure 8B:
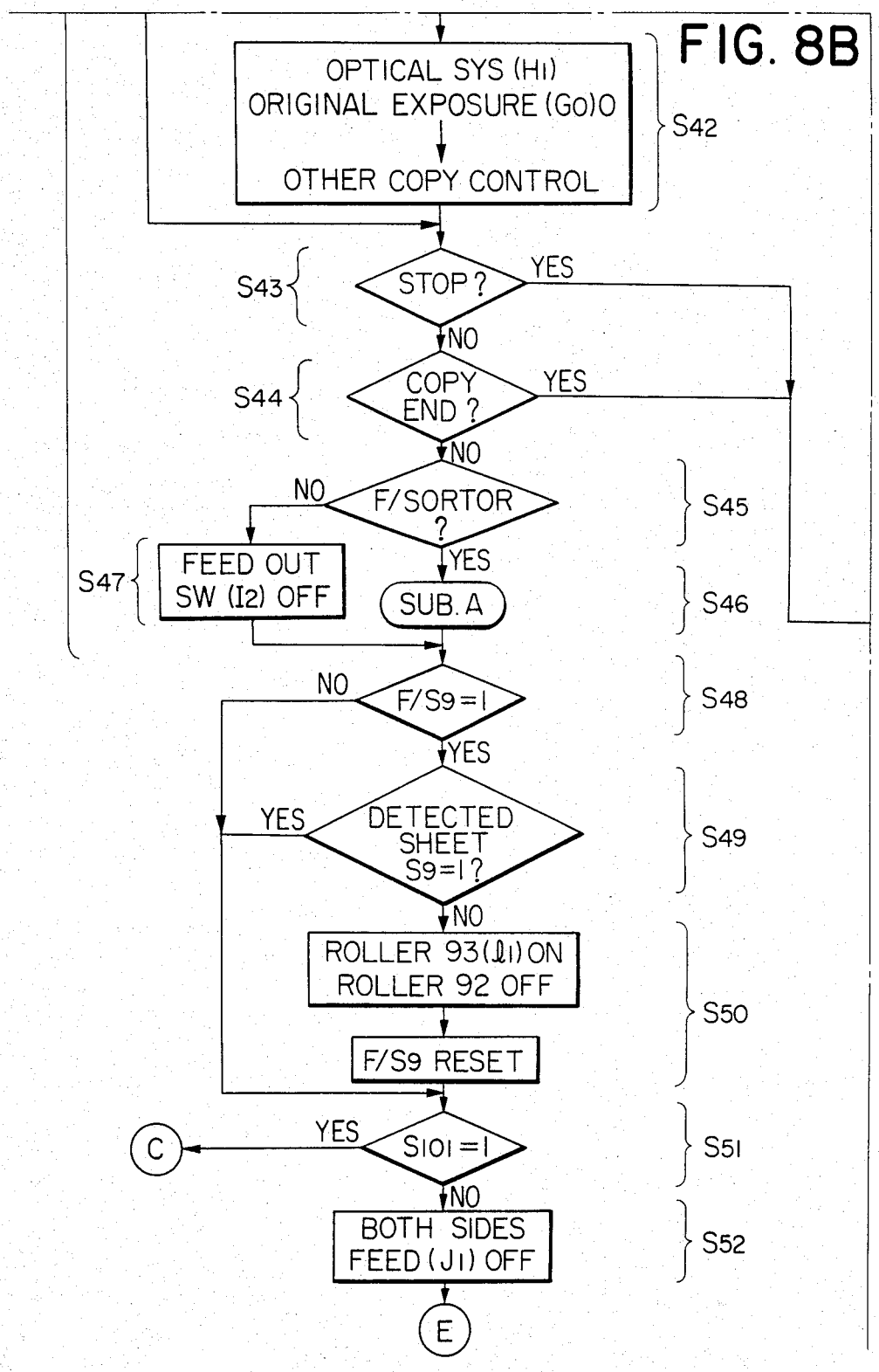
Figure 8C:
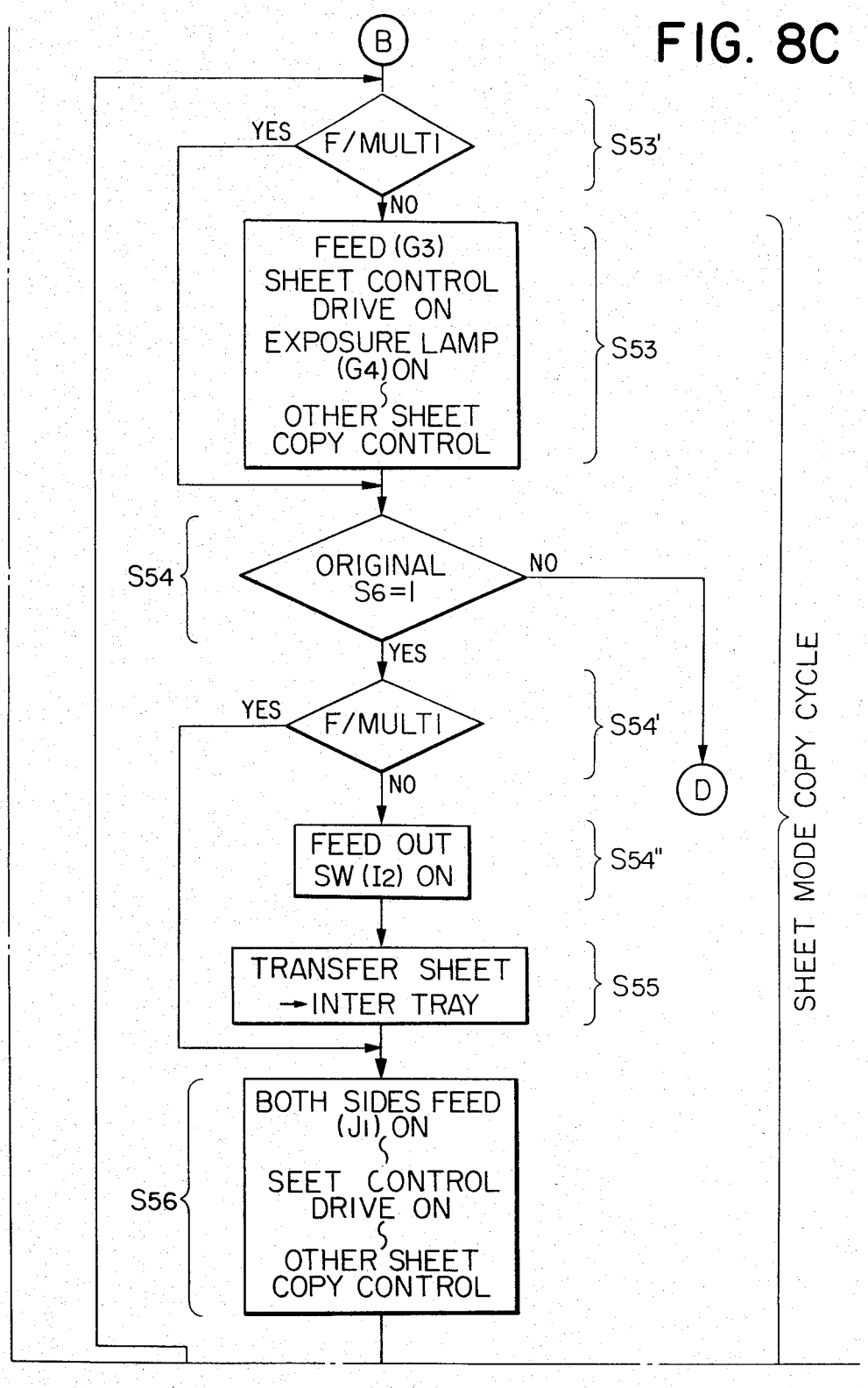

The copying operation in the sheet mode as described above is performed in steps S53 to S57 in the flowchart shown in FIGS. 7 and 8. In step S53, the transfer sheet is supplied from the cassette 28 or the paper feed deck 29 of the copying machine main body. In step S54, it is discriminated if the original is present by the sensor S6. If YES, the feedout switch lever 101 is switched to the position D in step S54''. In step S55, the transfer sheet is housed in the intermediate tray 106. In step S56, in order to form an image of another original on the back side of the transfer sheet on the front side of which an image is formed, the both side feed signal J1 is turned ON. In step S57, the feedout switch lever 101 is switched to the position C in order to house the transfer sheet in the feedout tray 49. When there are no more originals after repeating such operation, NO is obtained in step S54 and the sequence jumps to steps S58 and S59 to stop the operation of the machine. By the discrimination in steps S54 and S54' before the feedout switching operation, the transfer sheet corresponding to the last original is not housed in the intermediate tray 106 but is directly housed in the feedout tray 49. Steps S70 and S71 correspond to an interrupt routine effected by a drum clock pulse. When the operation of the copying machine main body is started, the drum clock pulse is generated and is supplied to the interrupt input terminal of the microcomputer. Then, the drum clock pulses are counted in step S70. The copying control elements are turned ON/OFF in accordance with the count value of the drum clock pulses in step S71.

Overlay copying which is one of the characteristic features of the present invention will now be described with reference to the flowcharts shown in FIGS. 7 and 8. Note that in this embodiment overlay copying cannot be performed in the both sides mode. Note also that the sheet mode cannot be set in the book mode. In the book mode, a predetermined format sheet original is placed on the original table 1. A desired number of copies is set with a copy number set key (not shown). After designating overlay copying, the copy start button (not shown) is depressed. First, in step S7'' in the standby cycle shown in FIG. 7, it is discriminated if overlay copying is selected. If YES occurs in step S7'', the flag F/MULTI is set. If NO occurs in step S7', the flag F/MULTI is reset in step S8''. Since overlay copying is selected in this case, the flag F/MULTI is set. The copy cycle is initiated upon depressing the copy start button. After steps S11 to S13, it is then discriminated if the flag F/MULTI is "1" in step S13'. Since a YES occurs in step S13' in this case, the sequence goes to step S14'. In step S14', a both sides drive signal I1 for starting the both sides copy drive motor and a feedout switch lever signal I2 for switching the feedout switch lever 101 are turned ON to guide the transfer sheet fed out from the copying machine main body in the direction F1. Since the signal for driving the convey path switch cam 103 is OFF in this case, the transfer sheet is conveyed not in the direction E but in the direction F1. When the convey path switch cam 113 is switched due to the ON state of the convey path switch signal J2 in step S14', the transfer sheet conveyed in the direction F1 is guided to the overlay copy convey path. When the transfer sheet is housed in the intermediate tray 106, its side with the image face down unlike in the case of both sides copying. Production of a desired number of copies which is set initially is performed through steps A14' and S15 to S24 in the flowchart shown in FIG. 7.

The sheet mode copying is then performed; images of other originals such as addresses, names and the like are copied on the images of the format recorded in the book mode. After steps S9, S10, S11, S13, S13', S14', and S15 and S18, the flag F/AF is set in step S19. Therefore, the flow advances to step S53'. Since the flag F/MULTI is set in step S53', it is then checked in step S54 if there is any sheet original. Since YES in step S54, the flow goes to step S54'. In step S54', it is discriminated if the flag F/MULTI is "1". Since YES in step S54', the flow advances to step S56. In step S56, the sheet mode copy control for the transfer sheet refed from the intermediate tray 106 as described above is performed. In step S57, the feedout switch signal I2 is turned OFF to switch the feedout switch lever 101 to the position C so as to house the transfer sheet which has been overlay-copied in the feedout tray 49. Overlay copying as described above is sequentially performed until NO occurs in step S54.

The above description is made on the case of overlay copying involving the book mode and the sheet mode. However, overlay copying in either mode can also be performed.

Figure 2:
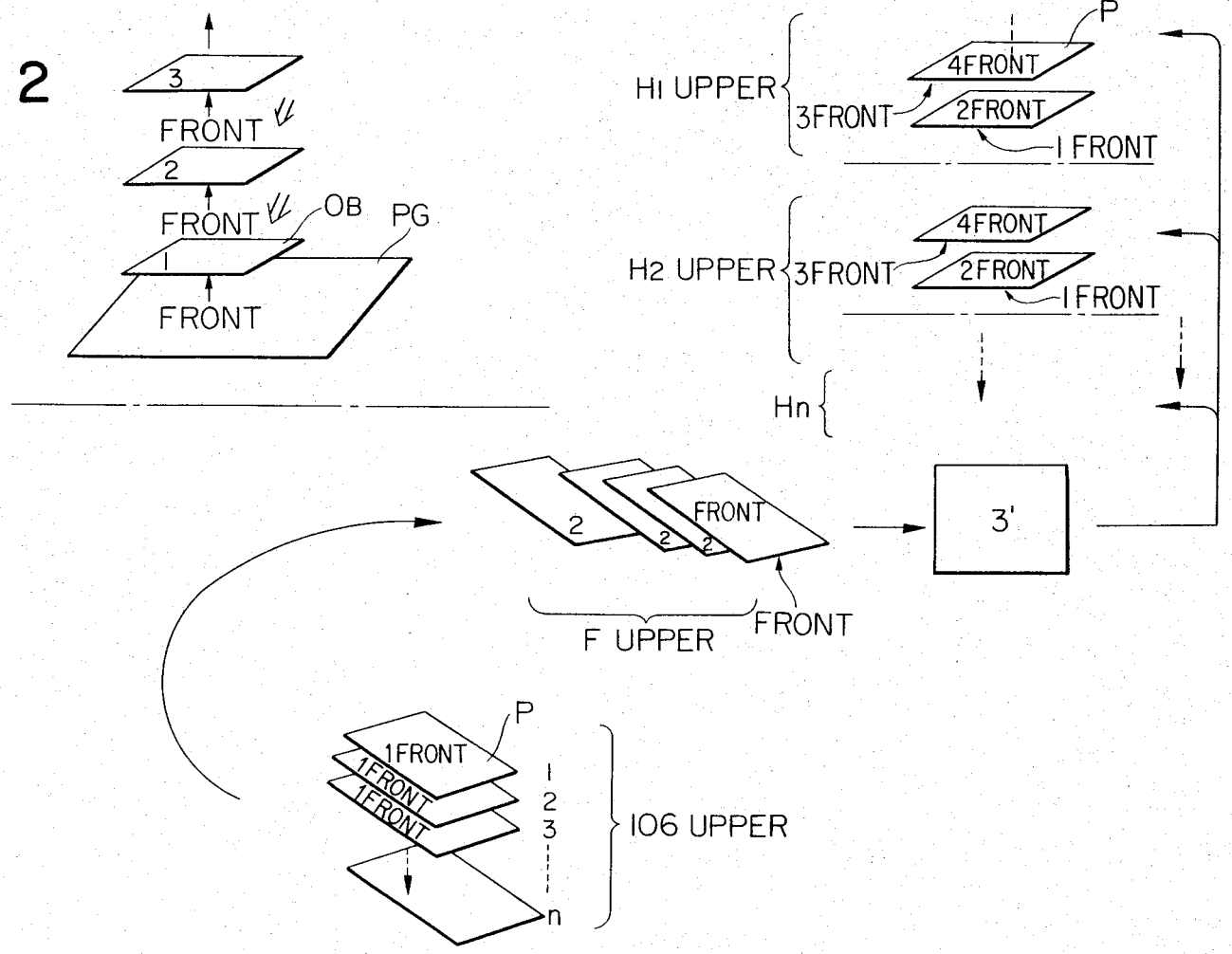
FIG. 2 is a representation showing the sequence of book mode of the copying machine shown in FIG. 1.
Figure 9:
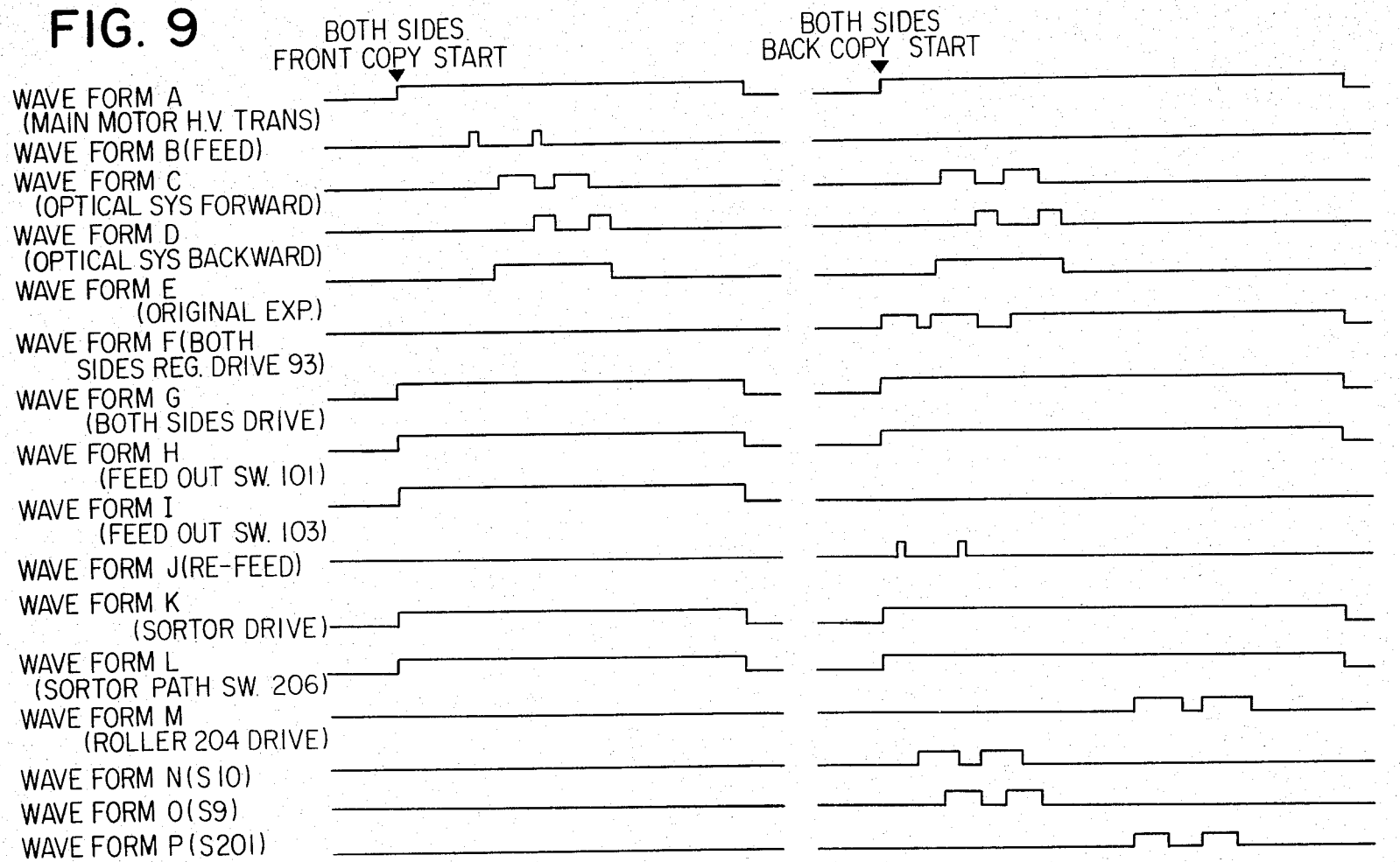
FIG. 9 shows timing charts for explaining the mode of operation in the both sides mode involving the book mode.
Figure 10:
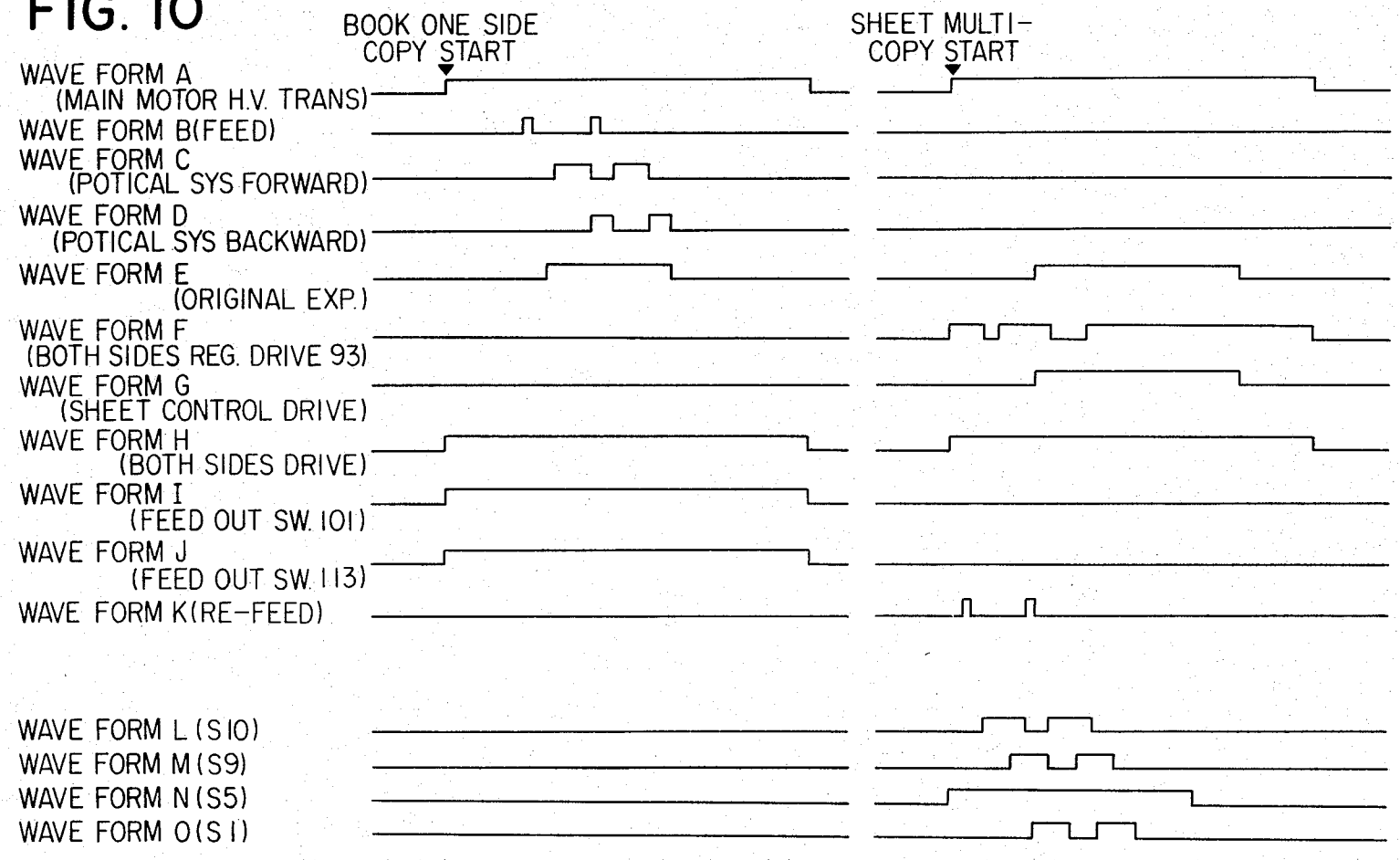
FIG. 10 shows timing charts for explaining the mode of operation in the both sides mode involving both the book mode and the sheet mode.
Figure 11:
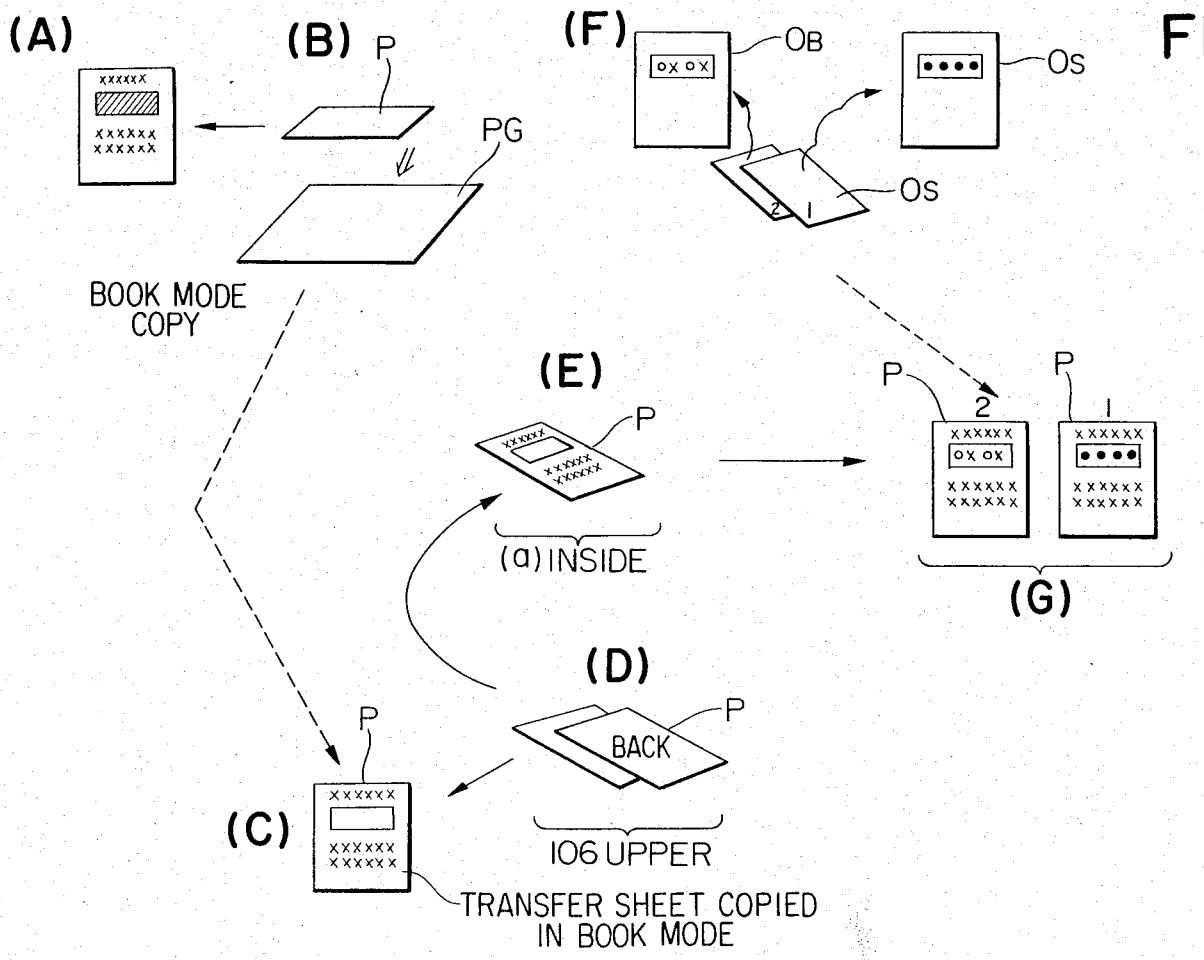
FIG. 11 is a representation showing the sequence, (A) to (G), of the both sides mode involving both the book mode and the sheet mode.

The timing charts of the respective operations for both sides copying in the book mode of the copying machine of the configuration as shown in FIG. 2 are shown by waveforms A to P in FIG. 9. Timing charts of the respective operations in overlay copying involving both the book mode and the sheet mode are shown by waveforms A to 0 in FIG. 10. Overlay copying involving both modes is sequentially shown in FIGS. 11(A) to 11(G). Fig. 11(A) shows a region (hatched) which is to be overlay-copied of an original of a predetermined format. FIG. 11(B) shows the manner according to which a transfer sheet P on which the predetermined format is to be copied is placed on a platen glass PG in the book mode. FIG. 11(C) shows the transfer sheet on which the predetermined format alone is copied in the book mode. FIG. 11(D) shows the state of the transfer sheet in the intermediate tray 106. FIG. 11(E) shows the state of the transfer sheet before overlay copying at the transfer unit of the copying machine main body. FIG. 11(F) shows the states of originals 1 and 2 corresponding to the hatched region to be overlay-copied in the sheet mode on the transfer sheet P with the format copied thereon. FIG. 11(G) shows the state of the transfer sheet which has been overlay-copied in correspondence with the originals 1 and 2.

In this manner, according to the present invention, overlay copying may be automatically performed with a simple operation.

Overlay copying may be extremely easily performed in the sheet mode. For example, different names may be recorded on sheets on which a predetermined format is recorded in the book mode. Thus, overlay copying may be performed without making complex the mechanisms of the copying machine having both functions of book mode and the sheet mode and without requiring complex procedures.

Although the present invention is described with reference to an electrographic copying machine in the above description, the present invention is not limited to this. For example, the present invention may be similarly applied to an ink jet printer, a thermal printer and the like.

What is claimed is:

1. An image recording apparatus comprising:

recording means for recording an image on a sheet, said recording means being capable of operating in a first mode and a second mode different from the first mode;

feeding means for feeding the sheet to said recording means so as to allow overlay recording on the same side of the sheet on which an image has been previously recorded by said recording means; and controlling means for controlling said recording means and said feeding means such that after image recording is performed on a desired number of sheets in the first mode, the overlay recording of an image on the same sides of the sheets is allowed in the second mode, and wherein said first and second modes are maintained, once they are commenced, until the image recording or the overlay image recording on the desired number of sheets is completed.

2. An apparatus according to claim 1, wherein the image of one original can be recorded on a plurality of sheets in the first mode.

3. An apparatus according to claim 1 or 2, wherein the image of one original is recorded on one sheet in the second mode.

4. An apparatus according to claim 1, wherein said recording means has scanning means for exposing/scanning the original on a platen, said scanning means scanning the original placed on said platen to form the image on the sheet in the first mode.

5. An apparatus according to claim 1 or 4, wherein said recording means has stationary exposing means and conveying means for conveying the original to an original position of said exposing means, said conveying means conveying the original to allow the original to be exposed at the original position and to allow the image to be formed on the sheet in the second mode.

6. An apparatus according to claim 1, wherein said apparatus is capable of forming the images on both sides of the sheet.

7. An apparatus according to claim 6, wherein said controlling means allows selection of an overlay recording mode in a both sides recording mode.

8. An image recording apparatus comprising:

recording module for recording an image on a sheet; and sheet processing module attachable to and detachable from said recording module for automatically receiving and temporarily storing the sheet on one side of which the image has been recorded by said recording module from which the sheet is conveyed thereto, and for re-transmitting the sheet to said recording module to perform further image recording selectively and alternatively on the same side of the sheet on which the image has been recorded, or on the other side of the sheet which is different from the side of the sheet on which the image has been recorded.

9. An apparatus according to claim 8, wherein said sheet processing means includes reversing means for reversing the sheet on one side of which the image has been recorded.

10. An apparatus according to claim 9 wherein said sheet processing means includes storage means for storing a plural number of sheets each having on one side thereof the image which has been recorded.

11. An image recording apparatus comprising:

recording means for recording an image of an original on a sheet, said recording means being operable in a first mode in which the original is exposed in a stationary state and in a second mode in which the original is exposed in a moving state;

feeding means for feeding the sheet to said recording means so as to allow overlay recording on the same side of the sheet on which the image is recorded by said recording means; and control means for controlling said recording means and said feeding means such that the overlay recording is allowed in the first and second modes.

12. An apparatus according to claim 11 wherein said recording means performs copying operations for one original on a set number of sheets to be copied in the first mode.

13. An apparatus according to claim 11 wherein said recording means performs a copying operation once for one original in the second mode.

* * * * *

UNITED STATES PATENT AND TRADEMARK OFFICE

CERTIFICATE OF CORRECTION

PATENT NO. : 4,537,497

DATED : August 27, 1985

INVENTOR(S) : SHUNICHI MASUDA

It is certified that error appears in the above-identified patent and that said Letters Patent is hereby corrected as shown below:

COLUMN 7

Line 56, "produce" should read --produced--.

COLUMN 9

Line 68, after "YES" insert --occurs--.

COLUMN 13

Line 63, delete "and".

Line 64, delete "and S18".

COLUMN 14

Line 11, "on the case" should read --with relation to--.

Signed and Sealed this

*Seventh* Day of *January 1986*

[SEAL]

*Attest:*

DONALD J. QUIGG

*Attesting Officer* *Commissioner of Patents and Trademarks*